US010509354B2

(12) United States Patent
Song et al.

(10) Patent No.: US 10,509,354 B2
(45) **Date of Patent: *Dec. 17, 2019**

(54) IMAGE FORMING APPARATUS

(71) Applicant: HP PRINTING KOREA CO., LTD., Suwon-si, Gyeonggi-do (KR)

(72) Inventors: Sung Weon Song, Seoul (KR); Young Min Yoon, Seoul (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/210,661

(22) Filed: Dec. 5, 2018

(65) Prior Publication Data

US 2019/0107802 A1 Apr. 11, 2019

Related U.S. Application Data

(63) Continuation of application No. 15/511,953, filed as application No. PCT/KR2015/003878 on Apr. 17, 2015, now Pat. No. 10,180,647.

(30) Foreign Application Priority Data

Sep. 26, 2014 (KR) ..... 10-2014-0129204

(51) Int. Cl.
*G03G 15/00* (2006.01)
*G03G 21/00* (2006.01)

(52) U.S. Cl.
CPC ..... *G03G 15/5054* (2013.01); *G03G 15/00* (2013.01); *G03G 21/00* (2013.01); *G03G 2215/00059* (2013.01)

(58) Field of Classification Search
CPC .... G03G 15/00; G03G 15/5054; G03G 21/00; G03G 21/0005; G03G 2215/00042; G03G 2215/00059
See application file for complete search history.

(56) References Cited

U.S. PATENT DOCUMENTS

| | | | | |
|---|---|---|---|---|
| 10,180,647 | B2 * | 1/2019 | Song | G03G 15/00 |
| 2008/0304119 | A1 | 12/2008 | Kim | |
| 2009/0016762 | A1 | 1/2009 | Ota | |
| 2009/0067871 | A1 | 3/2009 | Gunbe | |
| 2009/0142079 | A1 | 6/2009 | Sato et al. | |
| 2010/0014878 | A1 | 1/2010 | Tomita | |
| 2012/0134701 | A1 | 5/2012 | Sue | |
| 2013/0004189 | A1 | 1/2013 | Hashiguchi et al. | |
| 2013/0022378 | A1 | 1/2013 | Kim et al. | |
| 2014/0294420 | A1 | 10/2014 | Lee | |
| 2016/0313685 | A1 | 10/2016 | Yamana | |

FOREIGN PATENT DOCUMENTS

| | | |
|---|---|---|
| CN | 101275660 | 10/2008 |
| CN | 101320236 | 12/2008 |
| CN | 101630136 | 1/2010 |
| CN | 102193406 | 9/2011 |
| CN | 104076660 | 10/2014 |
| EP | 2290458 A1 | 3/2011 |

* cited by examiner

*Primary Examiner* — Sophia S Chen
(74) *Attorney, Agent, or Firm* — Staas & Halsey LLP

(57) ABSTRACT

An image forming apparatus includes a sensor assembly having a window and a sensor which senses a developer through the window, and a shutter device which opens and closes the window, and thereby sensing in a sensible state is maintained, and a lifetime thereof is extendable.

20 Claims, 19 Drawing Sheets

[Fig. 2]
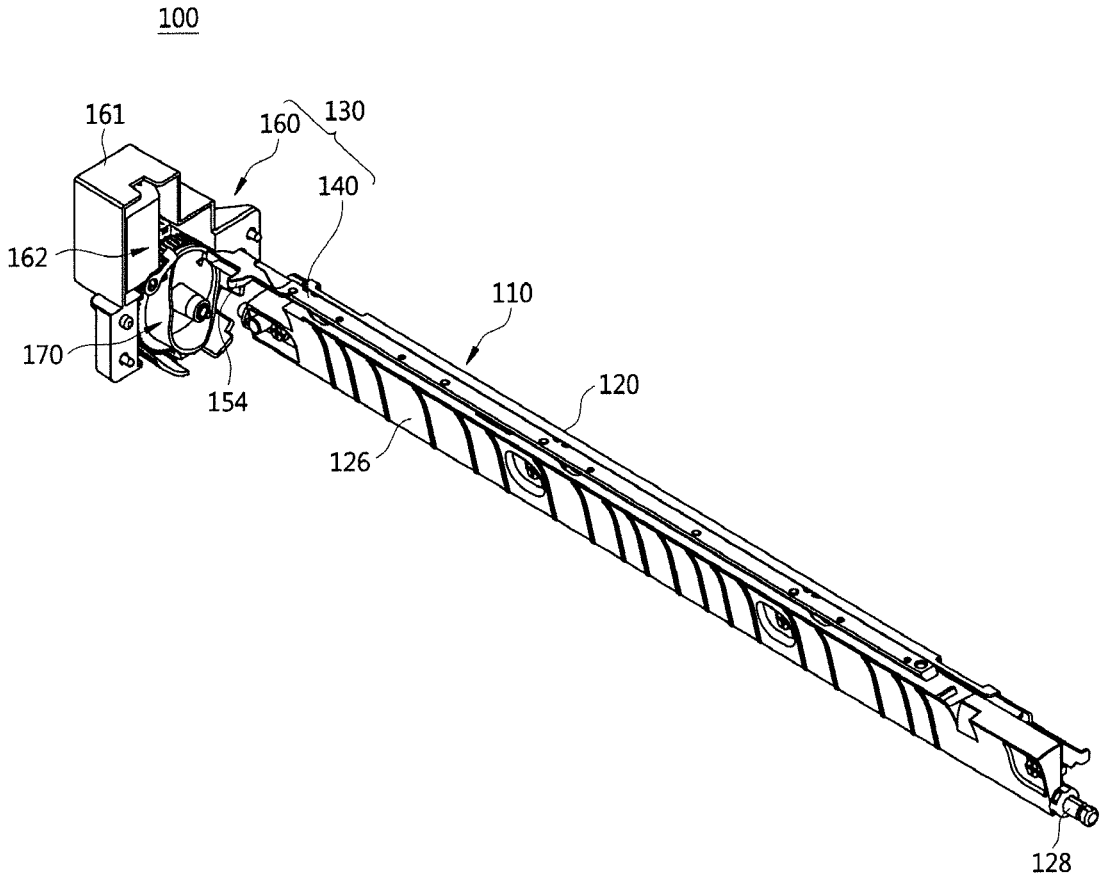

[Fig. 3]
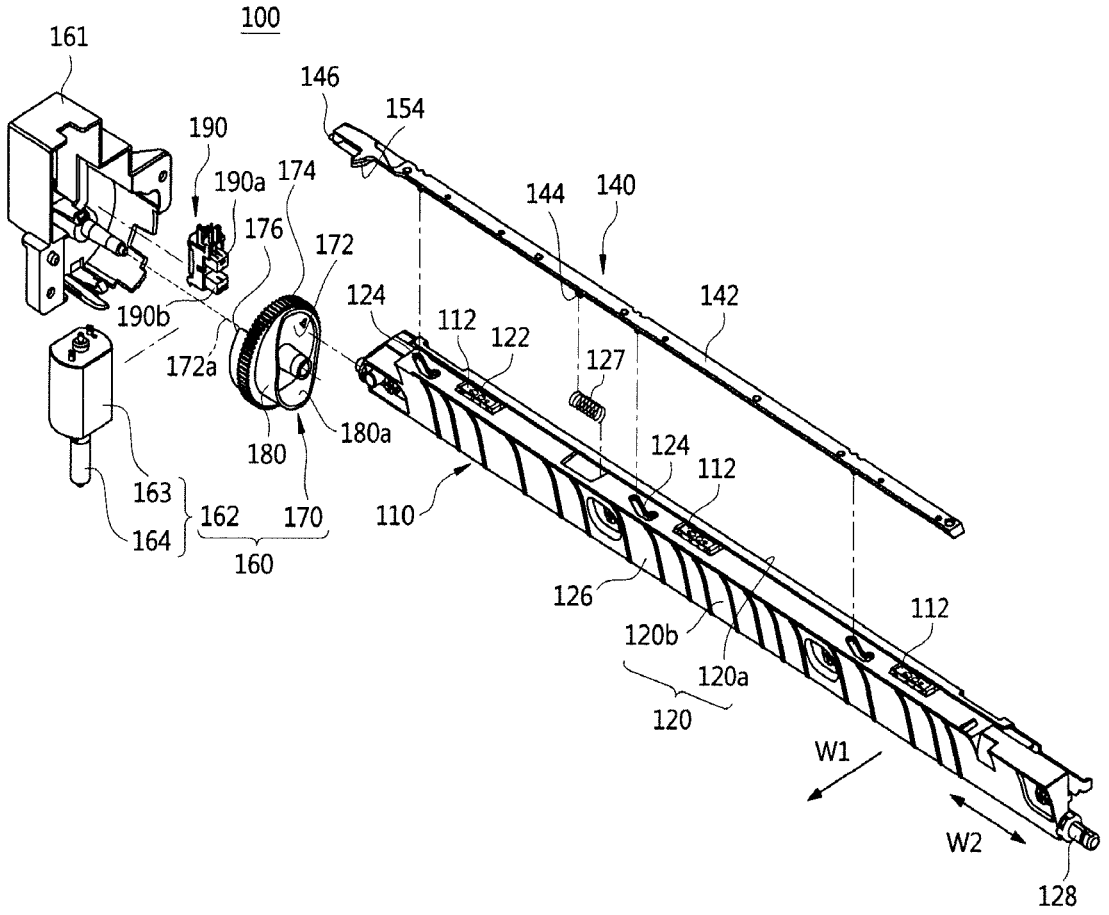

[Fig. 4]
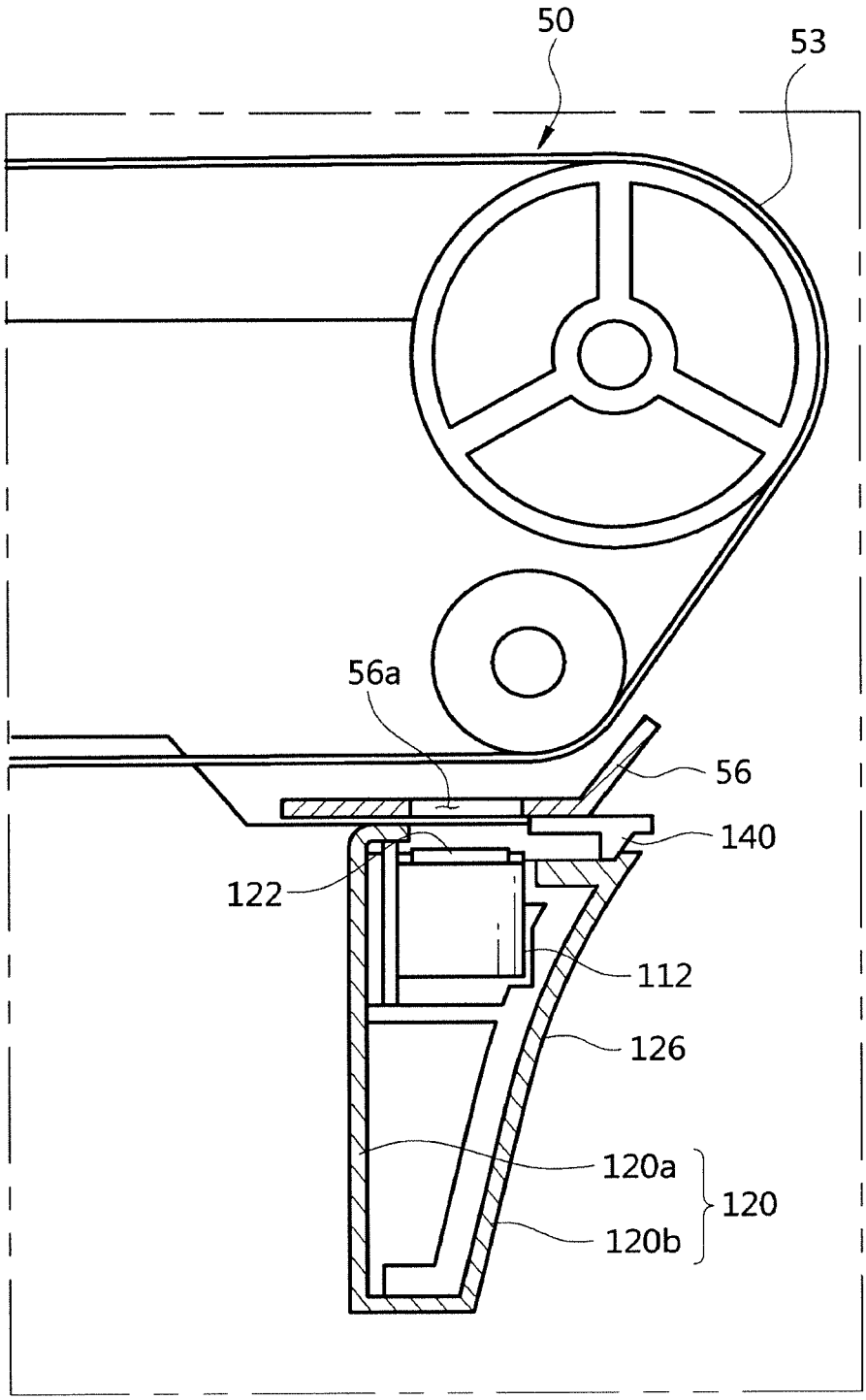

[Fig. 8]
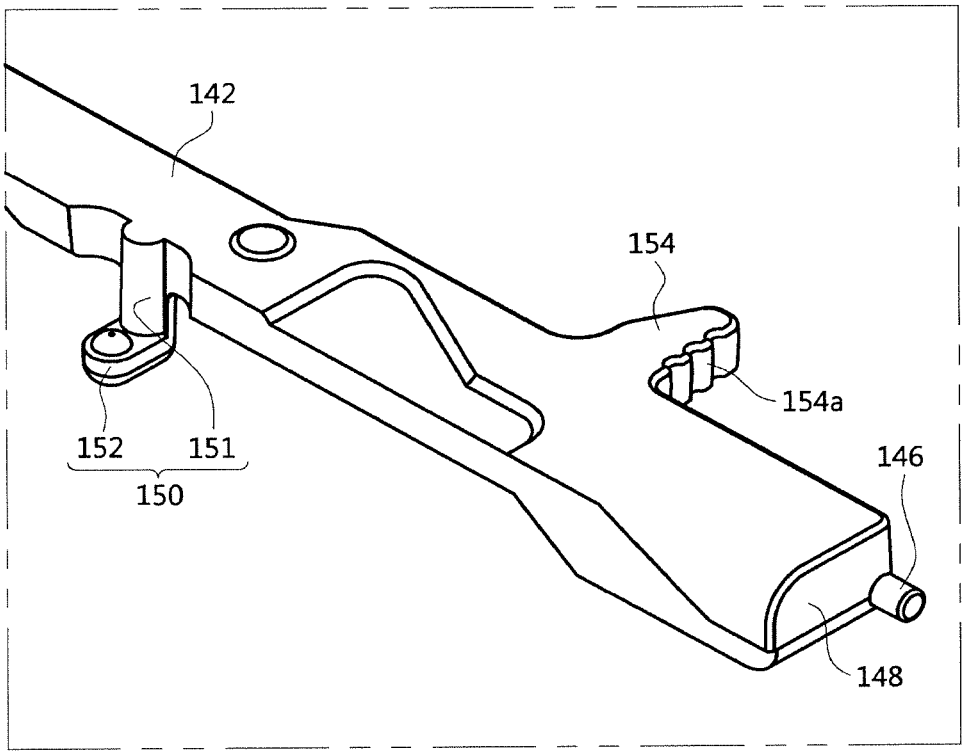

IMAGE FORMING APPARATUS

CROSS-REFERENCE TO RELATED APPLICATIONS

This application is a continuation patent application of U.S. patent application Ser. No. 15/511,953, filed on Mar. 16, 2017, which is a US national stage application claiming the benefit under 35 USC 371 of PCT International Patent Application no. PCT/KR2015/003878, filed Apr. 17, 2015, which claims priority from Korean Patent Application No. 10-2014-0129204 filed Sep. 26, 2014 in the Korean Intellectual Property Office, the entire disclosures of which are incorporated herein by reference.

TECHNICAL FIELD

Embodiments of the present invention relate to an image forming apparatus, and more particularly, an image forming apparatus with an structure in which sensing efficiency of an inside of image forming apparatus is improved.

BACKGROUND ART

Image forming apparatuses are devices for forming images on printing media according to input signals, and examples thereof include printers, copiers, facsimiles, and all-in-one devices implemented by a combination thereof.

One type of image forming apparatus, an electrophotographic image forming apparatus, includes a main body, a plurality of developing units which develop a visible image from an electrostatic latent image through a developer for each color in the main body, an exposure device which projects light onto photoreceptors of the plurality of developing units to form the electrostatic latent image on a photoreceptor of each developing unit, a transfer device which transfers the visible image developed on the photoreceptors to a printing medium, and a fixing device which fixes the developer onto the printing medium.

The transfer device includes a transfer member which receives the developer from the plurality of developing units and transfers the developer onto the printing medium, and a sensing unit which inspects the developer on the transfer member is disposed under one side of the transfer member.

DISCLOSURE

Technical Problem

The sensing unit includes a sensor formed as a light sensor, and as described above, since the sensing unit is disposed adjacent to the transfer member, the developer is inevitably accumulated on the sensor, and thus the sensor can be contaminated.

Technical Solution

Therefore, it is an aspect of the present invention to provide an image forming apparatus having an improved structure capable of maintaining a sensor of a transfer device in a sensible state.

In addition, it is another aspect of the present invention to provide an image forming apparatus capable of preventing the contamination caused by an external environment by selectively opening and closing the sensor.

Additional aspects of the invention will be set forth in part in the description which follows and, in part, will be obvious from the description, or may be learned by practice of the invention.

In accordance with one aspect of the present invention, an image forming apparatus includes a plurality of developing units configured to develop a visible image from an electrostatic latent image through a developer; a transfer member provided to transfer the visible image developed by the plurality of developing units onto a printing medium and rotated in a first direction; a sensing unit including at least one sensor disposed opposite the transfer member, and at least one window disposed between the at least one sensor and the transfer member and corresponding to the at least one sensor, and configured to sense a developer transferred onto the transfer member; and a shutter device having a shutter movably provided with displacement in the first direction, wherein the shutter opens and closes the window.

The shutter may include a first position at which the window is closed and a second position at which the window is opened, and the shutter may obliquely move according to the displacement in the first direction and displacement in a second direction perpendicular to the first direction between the first position and the second position.

The shutter device may include a shutter driving device having a cam gear which is rotatably provided and converts rotation of the cam gear into movement of the shutter for opening and closing the window, and configured to drive the shutter.

The cam gear may include a gear body, and a cam rail provided on one side of the gear body and configured to guide the movement of the shutter.

The shutter may be guided by the movement of the cam rail and may reciprocate in an oblique direction having the displacement in the first direction and displacement in a second direction perpendicular to the first direction according to rotation of the cam gear.

The shutter may include a shutter body configured to open and close the window, and a guide pole provided on the shutter body to be movable along the cam rail.

The cam rail may be formed such that a radial distance (r) from a center of the rotation of the cam gear to the cam rail varies according to rotation of the cam gear, and the guide pole may be guided by the cam rail by the rotation of the cam gear and moves based on the displacement in the first direction.

The shutter may include a first position at which the window is closed and a second position at which the window is opened, wherein the shutter may be positioned at the first position when a radial distance of the cam rail to which the guide pole is guided is r1, the shutter may be positioned at the second position when a radial distance of the cam rail to which the guide pole is guided is r2, and the r1 may be formed to be greater than the r2.

The shutter may have the displacement in the first direction by rotation of the cam gear and may reciprocate a distance between the r1 and the r2.

The cam rail may include a first cam rail having a radius of the r1, and a second cam rail having a radius of the r2.

The first cam rail may extend be longer than the second cam rail in an axial direction of the cam gear from the shutter body and.

The cam rail may be formed such that a height (h) in an axial direction of the cam gear varies according to rotation of the cam gear, and the guide pole may be provided to move according to the displacement in the first direction and displacement in a second direction perpendicular to the first direction along the cam rail by the rotation of the cam gear.

The shutter may include a first position at which the window is closed and a second position at which the window is opened, wherein the shutter may be positioned at the first position when a radial distance of the cam rail to which the guide pole is guided is r1 and a height in the axial direction is h1, the shutter may be positioned at the second position when a radial distance of the cam rail to which the guide pole is guided is r2 and a height in the axial direction is h2, and the r1 may be formed to be greater than the r2, and the h2 may be formed to be greater than the h1.

The shutter may obliquely move according to displacement in the first direction as much as a difference between the r1 and r2 and displacement in the second direction as much as a difference between the h1 and h2.

The shutter driving device may further include a driving unit having a driving motor configured to generate a rotating force and a worm rotated by the driving motor, and the cam gear may further include a worm wheel which is meshed with the worm and rotated.

The sensing unit may further include a sensor housing which accommodates the at least one sensor and a second direction perpendicular to the first direction is a longitudinal direction of the sensor housing, the shutter may include a first position at which the window is closed and a second position at which the window is opened, and the shutter may be moved from the first position to the second position by the shutter driving device, and moved from the second position to the first position by an elastic restoring force of an elastic member provided between the sensor housing and the shutter.

The sensing unit may further include a sensor housing which accommodates the at least one sensor, and a second direction perpendicular to the first direction is a longitudinal direction of the sensor housing, and the sensor housing may include a plurality of guide rails which are separated from each other in the second direction so that the shutter performs parallel movement and formed to obliquely move the shutter with displacement in the first direction and the second direction.

The shutter may include a first position at which the window is closed and a second position at which the window is opened, and the shutter body may be formed to entirely seal a surface located at the same level as the window in a width direction W2 of the transfer member from the sensor housing when the shutter is disposed at the first position.

The cam gear may include a detection part provided in an arc shape which extends in a circumferential direction on the other side of the gear body, and the shutter driving device may include a rotational position detection sensor which senses the detection part to detect a rotational position of the cam gear.

The shutter may include a manual open/close protrusion formed to protrude from the shutter body to be pressed by an external force and provided to move from the first position to the second position.

The shutter device may further include a shutter driving device for driving the shutter, and the shutter driving device may include a cam gear rotatably provided with a gear body, and a cam rail provided on one side of the gear body and formed to guide movement of the shutter, and a lever provided with one end in contact with the cam rail and the other end in contact with the shutter, and configured to transmit a driving force from the cam gear to the shutter.

A height (h) of the cam rail may change in an axial direction of the cam gear based on rotation of the cam gear, the shutter may move between a first position, at which the window is opened and closed, and a second position at which the window is closed, and the lever may press the shutter to move the shutter between the first position and the second position in the axial direction of the cam gear in contact with the lever based on a change in the height (h).

When a height in an axial direction of the cam gear in contact with the lever is h1, the shutter may be positioned at the first position, when a height in the axial direction of the cam gear in contact with the lever is h2, the shutter may be positioned at the second position, and the h2 may be formed to be greater than the h1.

The shutter may move to a first position, at which the window is closed, and a second position, at which the window is opened, separated from the first position in the first direction.

The shutter may move to a first position, at which the window is opened and closed, and a second position at which the window is closed, and the shutter device may further include a latch unit which guides movement of the shutter to the first position and the second position.

The sensing unit may include a sensor housing which accommodates the at least one sensor; the shutter may include a guide protrusion formed to protrude toward the sensor housing; and the latch unit may include a guide groove which is provided in the sensor housing and guides movement of the guide protrusion; a pair of protrusion mounting parts provided on the guide groove with a first protrusion mounting part on which the guide protrusion is mounted, and a second protrusion mounting part disposed to be further spaced in the first direction than the first protrusion mounting part, wherein, when the shutter is positioned at the first position, the guide protrusion may be mounted on the first protrusion mounting part, and when the shutter is positioned at the second position, the guide protrusion may be mounted on the second protrusion mounting part.

The guide groove may include a first guide groove configured to guide movement of the guide protrusion from the first protrusion mounting part to the second protrusion mounting part; and a second guide groove configured to guide movement of the guide protrusion from the second protrusion mounting part to the first protrusion mounting part and separated from the first guide groove.

The shutter device may further include a shutter driving device provided on one end of the shutter to press the shutter in a second direction, which is perpendicular to a first direction and is a direction from one end of the shutter to the other end of the shutter, for detaching the guide protrusion from any one of the first protrusion mounting part and the second protrusion mounting part; and the sensing unit may include an elastic restoring member provided on the sensor housing to elastically support the shutter in a third direction opposite the second direction for moving the guide protrusion, which is detached from any one of the first protrusion mounting part and the second protrusion mounting part by the shutter driving device, to the other thereof.

The shutter driving device may include a solenoid provided to be moved back and forth.

The latch unit may further include a guide bar provided on the shutter to form the guide protrusion on an end portion thereof and formed in a longitudinal direction of the shutter.

In accordance with another aspect of the present invention, an image forming apparatus includes a plurality of developing units configured to develop a visible image from an electrostatic latent image through a developer; a transfer member provided to transfer the visible image developed by the plurality of developing units onto a printing medium; a sensing unit having at least one sensor, on which a window is formed, disposed opposite the transfer member and a sensor housing in which the at least one sensor is accommodated, and configured to sense a developer transferred onto the transfer member; and a shutter device having a shutter which opens and closes the window, and a shutter driving device which drives the shutter, and configured to open and close the sensing unit, wherein the shutter driving device includes a driving unit which generates a driving force; and a cam gear which is rotated by receiving the driving force from the driving unit and operates the shutter; and the cam gear includes a gear body; and a cam rail having a first cam rail having a radius of r1 from a center of rotation of the cam gear and a second cam rail having a radius of r2 smaller than the r1, and provided on one side surface of the gear body to restrict the shutter so that the shutter reciprocates according to a moving component of a moving direction of the transfer member.

The shutter may reciprocate according to displacement between the r1 and the r2 according to the moving component of the moving direction of the transfer member.

The first cam rail may be formed to have the gear body and a height of h1, and the second cam rail is formed to have the gear body and a height of h2 greater than the h1; and the shutter may obliquely move according to displacement between the h1 and the h2 based on a moving component of a width direction of the transfer member together with the moving component of the moving direction of the transfer member.

In accordance with still another aspect of the present invention, an image forming apparatus includes a plurality of developing units configured to develop a visible image from an electrostatic latent image through a developer; a transfer member provided to transfer the visible image developed by the plurality of developing units onto a printing medium; a sensing unit having a plurality of sensors, which is opposite the transfer member and disposed to be separated from each other in an A direction, and a plurality of windows provided between the plurality of sensors and the transfer member and corresponding to the plurality of sensors, and configured to sense a developer transferred onto the transfer member; and a shutter device having a shutter formed to be movable according to displacement in a B direction perpendicular to the A direction and formed to be movable, wherein the shutter opens and closes the plurality of windows.

The shutter may include a first position at which the window is closed and a second position at which the window is opened, and the shutter may obliquely move according to displacement in the A direction and displacement in the B direction between the first position and the second position.

In accordance with yet another aspect of the present invention, an image forming apparatus includes a plurality of developing units configured to develop a visible image from an electrostatic latent image through a developer; a transfer member provided to transfer the visible image developed by the plurality of developing units onto a printing medium; a sensing unit having at least one sensor which has a light emitting part, a light receiving part separated from the light emitting part in an A direction and configured to receive light which is transferred from the light emitting part and reflected by the transfer member, a sensor bracket which accommodates the light emitting part and the light receiving part, and a window corresponding to the light emitting part and the light receiving part, and configured to sense a developer transferred onto the transfer member; and a shutter device having a shutter unit to be movable according to displacement in a B direction perpendicular to the A direction and configured to be movable, wherein the shutter unit has a shutter which opens and closes the window.

In accordance with yet another aspect of the present invention, an image forming apparatus includes a plurality of developing units configured to develop a visible image from an electrostatic latent image through a developer; a transfer member provided to transfer the visible image developed by the plurality of developing units onto a printing medium and rotated in a first direction; a sensing unit including at least one sensor disposed opposite the transfer member, and at least one window disposed between the at least one sensor and the transfer member and corresponding to the at least one sensor, and configured to sense a developer transferred onto the transfer member; and a shutter device configured to move between a first position at which the window is opened and closed, and a second position at which the window is opened, and separated from the first position according to displacement in the first direction from the first position, wherein the shutter device has a shutter which opens and closes the window, and a latch unit which guides movement of the shutter.

The sensing unit may include a sensor housing which accommodates the at least one sensor; the shutter may include a guide protrusion formed to protrude toward the sensor housing; and the latch unit may include a guide groove provided on the sensor housing and configured to guide movement of the guide protrusion; and a pair of protrusion mounting parts having a first protrusion mounting part on which the guide protrusion is mounted, and a second protrusion mounting part disposed to be further spaced in the first direction than the first protrusion mounting part, and provided on the guide groove, wherein, when the shutter is positioned at the first position, the guide protrusion may be mounted on the first protrusion mounting part, and when the shutter is positioned at the second position, the guide protrusion may be mounted on the second protrusion mounting part.

The guide groove may include a first guide groove configured to guide movement of the guide protrusion from the first protrusion mounting part to the second protrusion mounting part; and a second guide groove configured to guide movement of the guide protrusion from the second protrusion mounting part to the first protrusion mounting part and separated from the first guide groove.

The shutter device may further include a shutter driving device provided on one end of the shutter to press the shutter in a 2a direction, which is perpendicular to the first direction and is a direction from one end of the shutter to the other end of the shutter, for detaching the guide protrusion from any one of the first protrusion mounting part and the second protrusion mounting part; and the sensing unit may include an elastic restoring member provided on the sensor housing to elastically support the shutter in a 2b direction opposite the 2a direction for moving the guide protrusion, which is detached from any one of the first protrusion mounting part and the second protrusion mounting part by the shutter driving device, to the other thereof.

The shutter driving device may include a solenoid provided to be moved back and forth.

The latch unit may further include a guide bar provided on the shutter to form the guide protrusion on an end portion thereof and formed in a longitudinal direction of the shutter.

Advantageous Effects

As is apparent from the above description, since the image forming apparatus according to the embodiment of the present invention may selectively maintain the sensor in a sensible state through the shutter device, and thus the sensor can be maintained in a best state.

Further, the shutter device can automatically open and close in linkage with an operation of the image forming, and can also be manually opened and closed for maintenance.

DESCRIPTION OF DRAWINGS

FIG. 2 is a perspective view of a sensing assembly according to the first embodiment of the present invention;

FIG. 3 is an exploded perspective view of the sensing assembly according to the first embodiment of the present invention;

FIG. 4 is a view illustrating movement of the sensing assembly according to the first embodiment of the present invention;

FIG. 8 is an enlarged view illustrating a part of the shutter according to the first embodiment of the present invention;

BEST MODE

Figure 1:
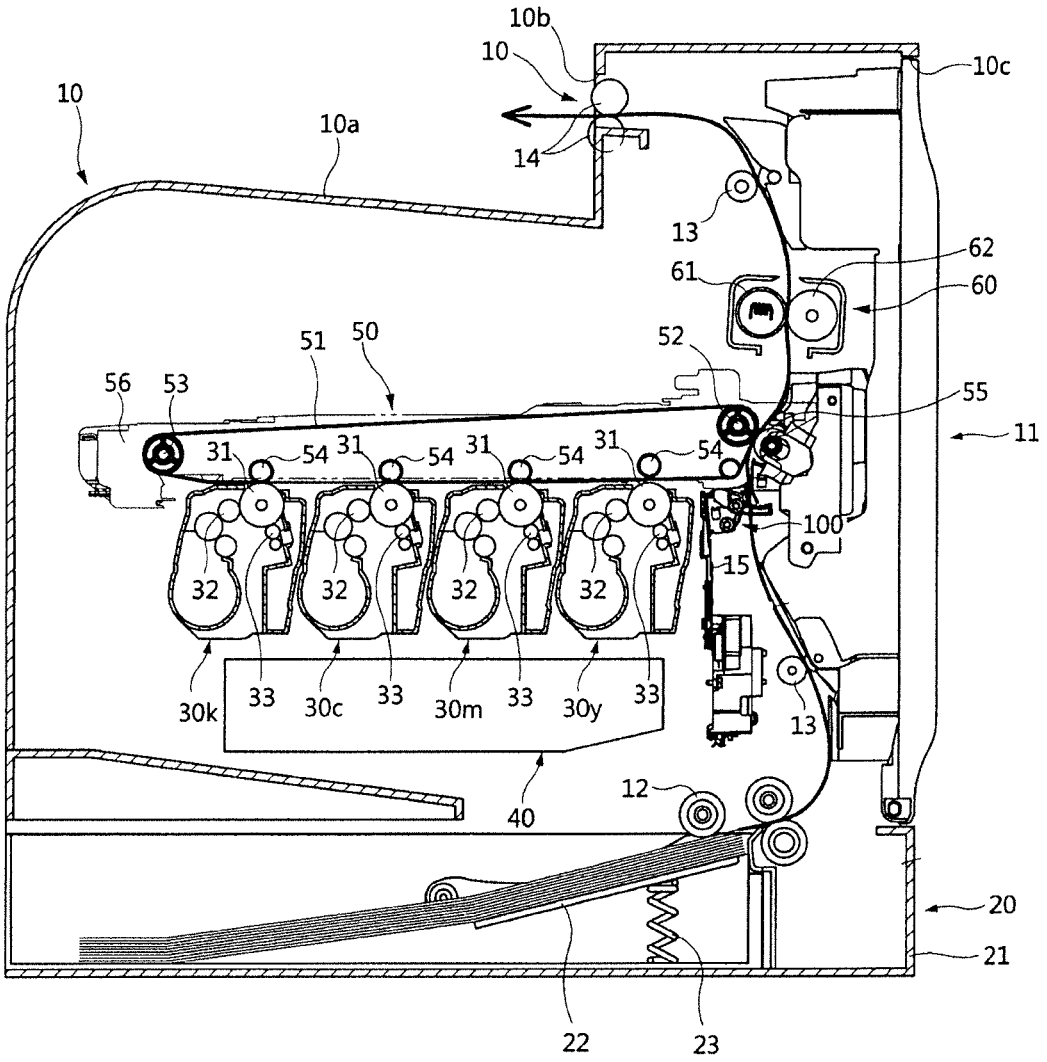
FIG. 1 is a cross-sectional view of an image forming apparatus according to a first embodiment of the present invention.

Reference will now be made in detail to the embodiments of the present invention, examples of which are illustrated in the accompanying drawings, wherein like reference numerals refer to like elements throughout.

FIG. 1 is a cross-sectional view of an image forming apparatus according to a first embodiment of the present invention.

As shown in FIG. 1, an image forming apparatus according to one embodiment of the present invention includes a main body 10 which forms an exterior thereof, a printing medium storage unit 20 in which a printing medium is stored, a plurality of developing units 30*c*, 30*m*, 30*y*, and 30*k* which develop a visible image from an electrostatic latent image according to colors through a developer, an exposure unit 40 which forms an electrostatic latent image by projecting light onto photoreceptors 31 of the charged developing units 30*c*, 30*m*, 30*y*, and 30*k*, a transfer device 50 which transfers a visible image formed in the photoreceptors 31 to a printing medium transferred from the printing medium storage unit 20, a fixing unit 60 which fixes the developer transferred to the printing medium, and a sensing unit 110 which inspects the developer formed on a transfer member 51 of the transfer device 50.

The main body 10 includes a loading part 10*a* on which a printing medium on which an image is completely formed is loaded, and a paper ejection port bob which is provided on one side and ejects the printing medium on which the image is formed completely. Further, the main body 10 includes an opening 10C provided on one side for repairing and replacing internal components or replacing consumables, and a side cover 11 of which a lower end is rotatably installed on the main body 10 to be capable of rotating about the lower end thereof for opening and closing the opening 10*c*.

The printing medium storage unit 20 includes a printing medium cassette 21 movably installed in the main body 10, a knock-up plate 22 disposed in the printing medium cassette 21 on which a printing medium is loaded, and a knock-up spring 23 which elastically supports the knock-up plate 22.

The developing units 30*c*, 30*m*, 30*y*, and 30*k* each include a photoreceptor 31 in which an electrostatic latent image is formed on a charged surface thereof by the exposure unit 40, a developing roller 32 which supplies a developer to the photoreceptor 31, and a charging unit 33 which charges a surface of the photoreceptor 31.

In the embodiment of the present invention, the developing units 30*c*, 30*m*, 30*y*, and 30*k* include four developing units 30*c*, 30*m*, 30*y*, and 30*k* which each store any one of cyan (C), magenta (M), yellow (Y), and black (K) developers which develop respective C, M, Y, and K colors. The four developing units 30*c*, 30*m*, 30*y*, and 30*k* are disposed under the transfer device 50 and parallel to each other.

The exposure unit 40 projects light having image data onto the photoreceptors 31 respectively provided in the developing units 30*c*, 30*m*, 30*y*, and 30*k* to form an electrostatic latent image on surfaces of the photoreceptors 31.

The transfer device 50 is rotatably installed on the transfer member 51 to which a visible image developed on the photoreceptor 31 of each of the developing units 30*c*, 30*m*, 30*y*, and 30*k* overlaps and is transferred, a driving roller 52 and a driven roller 53 are disposed on both sides of an inner surface of the transfer member 51 to rotate the transfer member 51, and a plurality of first transfer rollers 54 which are in a state in which the transfer member 51 is interposed therebetween, are opposite the respective developing units 30*c*, 30*m*, 30*y*, and 30*k*, and transfer the visible image formed on the photoreceptors 31 onto the transfer member 51, and a transfer device frame 57, on which both ends of the first transfer rollers 54, the driving roller 52, the driven roller 53 are rotatably installed.

A reinforced frame 56 is provided under the transfer member 51 for reinforcing the strength of the transfer member 51, and a through-hole 56*a* is provided in the reinforced frame 56 at a location corresponding to a window 122 included in a sensing assembly 100, which will be described below, so that a sensor 112 may inspect a developer on the transfer member 51.

Meanwhile, a second transfer roller 55 disposed opposite the driving roller 52 in a state, in which the transfer member 51 is interposed therebetween, is disposed on the side cover 11 and the transfer member 51 presses a printing medium to transfer the visible image of the transfer member 51 to the printing medium. Accordingly, the transfer member 51 transfers the visible image made by the developer transferred from the developing unit 30 onto the printing medium.

The fixing unit 60 includes a heating roller 61 which generates heat, and a pressing roller 62 which is formed of an changeable elastic material to press the printing medium onto an outer circumference surface of the heating roller 61.

Further, a pick-up roller 12 which is disposed on the printing medium storage unit 20 and picks up a printing medium loaded on the knock-up plate 22 one sheet at a time, feeding rollers 13 which upwardly guide the printing medium picked up by the pick-up roller 12, and a paper ejecting roller 14 disposed above the fixing unit 60 and adjacent to the paper ejection port 10*b* so that the printing medium passed through the fixing unit 60 is ejected through the paper ejection port 10*b* are disposed inside the main body 10.

Furthermore, frames are provided inside the main body 10 to install and support the above described components, and a main body frame 15 of the frames is disposed at a lower side from an inner side of the opening 10C and the above described sensing assembly 100 is installed on the main body frame 15.

Figure 5A:
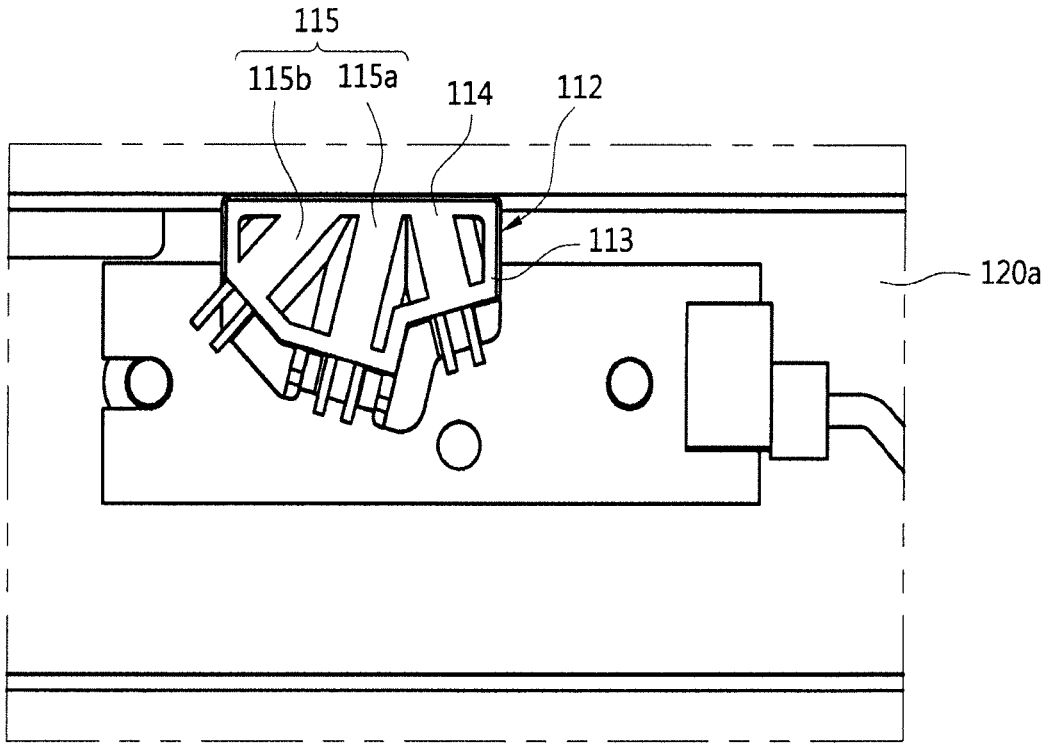
FIGS. 5A and 5B are views illustrating a sensor according to the first embodiment of the present invention.
Figure 5B:
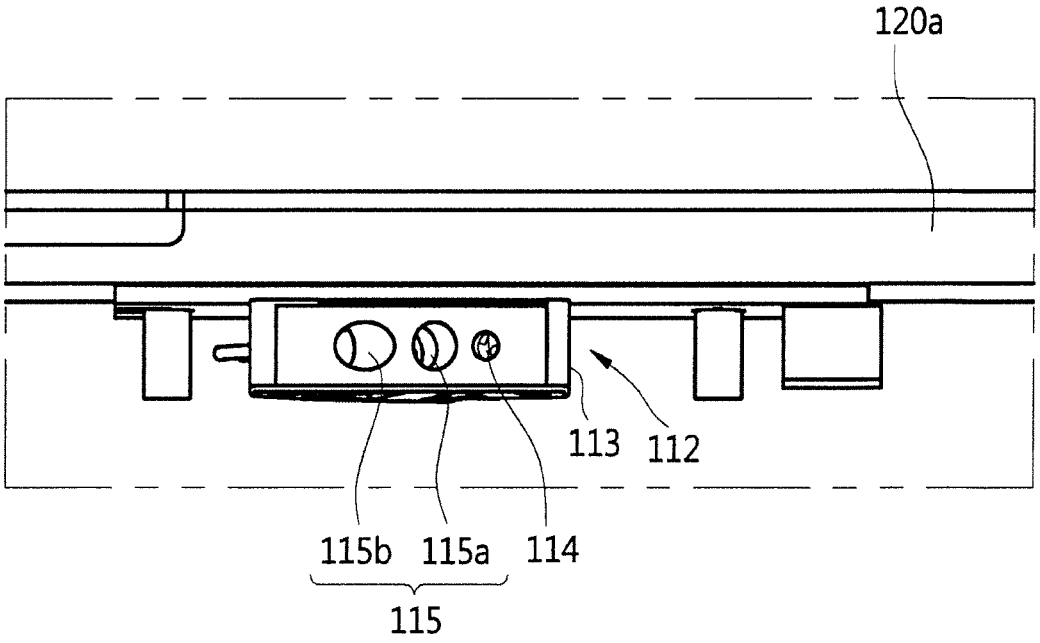

FIG. 2 is a perspective view of a sensing assembly according to the first embodiment of the present invention, FIG. 3 is an exploded perspective view of the sensing assembly according to the first embodiment of the present invention, FIG. 4 is a view illustrating movement of the sensing assembly according to the first embodiment of the present invention, and FIGS. 5A and 5B are views illustrating a sensor according to the first embodiment of the present invention.

In the detailed description, a first direction W1 refers to a moving direction of the transfer member 51, and a second direction W2 refers to a width direction of the transfer member 51. The first direction W1 and the second direction W2 may be provided to be perpendicular to each other.

The sensing assembly 100 includes a sensing unit 110 and a shutter device 130 provided to selectively open and close the sensing unit 110.

The sensing unit 110 is provided to inspect a developer on the transfer member 51.

In detail, the sensing unit 110 may be provided to detect whether a plurality of colors transferred from the photoreceptors 31 are arranged and transferred to the transfer member 51 in a process of transferring a visible image developed on the photoreceptors 31 of the plurality of developing units onto a printing medium.

The sensing unit 110 is adjacent to the transfer member 51. In detail, the sensing unit 110 is disposed under the transfer member 51 to face a lower surface of the transfer member 51 so that a developer on the transfer member 51 is inspected.

The sensing unit 110 includes a plurality of sensors 112 which inspect the developer on the transfer member 51, and a sensor housing 120 in which the plurality of sensors 112 are accommodated and installed.

The sensor housing 120 is provided to dispose the plurality of sensors 112 therein and formed in a long shape along the second direction W2. The plurality of sensors 112 are separated from each other in a longitudinal direction of the sensor housing 120. A window 122 formed of a transparent material is provided in the sensor housing 120 to transfer light of the sensors 112. The window 122 may be disposed between the sensors 112 and the transfer member 51 so that the sensors 112 are not directly influenced by an external environment. A first sensor housing 120*a* and a second sensor housing 120*b* of the sensor housing 120 are coupled so that the plurality of sensors 112 are interposed therebetween.

The sensors 112 include photosensors, and are provided inside the sensor housing 120 as shown in FIGS. 3, 4, 5A, and 5B. The number of the sensors 112 is not limited, and three sensors 112 separated from each other are provided in the embodiment of the present invention.

The sensor 112 may include a sensor bracket 113, a light emitting part 114, and a light receiving part 115. Light emitted from the light emitting part 114 is reflected by the transfer member 51 and transmitted to the light receiving part 115. The light receiving part 115 includes a regular reflection light receiving part 115*a* which receives regular reflection light of the reflected light, and a diffused reflection light receiving part 115*b* which receives diffused reflection light. The sensor bracket 113 is provided to accommodate the above described light emitting part 114 and light receiving part 115. The light emitting part 114 and the light receiving part 115 may be disposed to be separated from each other in an A direction Wa. The A direction Wa is not limited, and the A direction Wa is the same as the second direction W2 in the embodiment of the present invention.

At least one guide rail 124 may be provided above the sensor housing 120 to guide movement of a shutter 140 which will be described below. In detail, the at least one guide rail 124 is provided in a groove shape to guide movement of at least one shutter protrusion 150 provided on the shutter 140.

The shape of the guide rail 124 is not limited, and since the shutter 140 having a first direction W1 component and a second direction W2 component obliquely moves in an oblique direction in the embodiment of the present invention, the guide rail 124 is also provided in a groove shape in an oblique direction with respect to a longitudinal direction of the sensor housing 120. However, the shape of the guide rail 124 is not limited thereto, and it may be formed to extend only in the first direction W1 or formed to extend only in the second direction W2, in consideration of the moving direction of the shutter 140.

A printing medium guide face 126 may be formed on one surface of the sensor housing 120 for guiding movement of a printing medium. The printing medium guide face 126 is provided to guide a printing medium supplied from the printing medium storage unit 20 and may be formed to have a curved surface.

The shutter device 130 is provided to open and close the sensing unit 110. In detail, the shutter device 130 opens and closes the sensing unit 110 to selectively inspect the transfer member 51 only when the transfer member 51 of the sensing unit 110 is required to be sensed.

Accordingly, when inspection of a developer on the transfer member 51 is not required, a state in which the window 122 is covered and hidden by the shutter 140 is maintained, and the shutter 140 may be moved to open the window 122 only when the inspection of the developer on the transfer member 51 is required through the sensor 112.

The shutter device 130 includes the shutter 140 and a shutter driving device 160.

The shutter 140 is movably provided to open and close the window 122 of the sensing unit 110. The shutter 140 is interposed between the sensing unit 110 and the transfer member 51. That is, the shutter 140 is provided above the sensing unit 110 to selectively open and close the window 122 of the sensing unit 110.

The shutter 140 may have displacement in a first direction W1 and be opened and closed above the sensing unit 110. In FIG. 1, the transfer member 51 is rotated in a counterclockwise direction, and a developer which is passed above the sensing unit 110 and detached from the transfer member 51 may flow backward and be accumulated on the sensing unit 110. Therefore, the shutter 140 is opened and closed according to the displacement in the first direction W1, and thus accumulation of the developer detached from the transfer member 51 onto the sensing unit 110 can be prevented. In detail, the shutter 140 is provided to move in the first direction W1, which is a direction of rotation of the transfer member 51, and thus accumulation of the developer can be prevented.

Further, an operation of the shutter 140 from the perspective of a plurality of sensors 112 will be described. The plurality of sensors 112 may be opposite the transfer member 51 and separated from each other in the A direction Wa. The shutter 140 may be movable according to displacement in a B direction Wb perpendicular to the A direction Wa. For the sake of convenience, in the embodiment of the present invention, the A direction Wa and the B direction Wb may be the same as the second direction W2 and the first direction W1, respectively. However, when arrangement of the plurality of sensors 112 is different from that of the embodiment of the present invention, the A direction Wa and the B direction Wb may be different from the second direction W2 and the first direction W1.

Furthermore, the operation of the shutter 140 from the perspective of a configuration of each sensor 112 will be described.

The light emitting part 114 and the light receiving part 115 of each sensor 112 may be separated from each other in the A direction Wa. The shutter 140 may be movable according to displacement in the B direction Wb perpendicular to the A direction Wa. For the sake of convenience, in the embodiment of the present invention, the A direction Wa and the B direction Wb may be the same as the above described second direction W2 and the first direction W1, respectively. However, when arrangement of the plurality of sensors 112 is different from that of the embodiment of the present invention, the A direction Wa and the B direction Wb may be different from the second direction W2 and the first direction W1.

The shutter 140 is provided to move between a first position P1 at which the window 122 is closed and a second position P2 at which the window 122 is opened. The shutter 140 may reciprocate between the first position P1 and the second position P2 through the shutter driving device 160, and in the embodiment of the present invention, the movement from the first position P1 to the second position P2 is performed by the shutter driving device 160, and the movement from the second position P2 to first position P1 is performed by an elastic force of an elastic restoring member 127.

One end of the elastic restoring member 127 is connected to the sensor housing 120, and the other end thereof is fixedly provided to a hook protrusion 144 of the shutter 140. For example, a coil spring may be applied to the elastic restoring member 127.

The shutter driving device 160 may be provided so that the shutter 140 is movable.

The shutter driving device 160 includes a driving part 162 and a cam gear 170.

The driving part 162 generates a driving force to move the shutter 140. Various methods may be applied to the driving part 162 for generating the driving force, and in the embodiment of the present invention, the driving part 162 is provided to include a driving motor 163 for generating a rotating force and a worm 164 rotated by the driving motor 163.

The shutter driving device 160 may include a drive case 161 which accommodates a rotational position detection sensor 190 and components of the shutter driving device 160.

The rotational position detection sensor 190 may include a photosensor having a light emitting part 190*a* and a light receiving part 190*b*, and a detection part 176, which will be described below, selectively blocks light which is passed between the light emitting part 190*a* and the light receiving part 190*b* based on a rotation angle of the cam gear 170 and is transferred from the light emitting part 190*a* to the light receiving part 190*b*. Accordingly, locations of a cam rail 180 and the shutter 140 may be detected. That is, according to whether the detection part 176 detects light between the light emitting part 190*a* and light receiving part 190*b* or not, the shutter 140 may recognize a first set angle Θ1 of the cam gear 170 corresponding to the first position P1 in a state in which the window 122 corresponding to the sensors 112 is closed, and a second set angle Θ2 of the cam gear 170 corresponding to the second position P2 in a state in which the window 122 corresponding to the sensors 112 is opened.

The rotational position detection sensor 190 may correspond to the detection part 176 at one side of the cam gear 170.

Figure 6A:
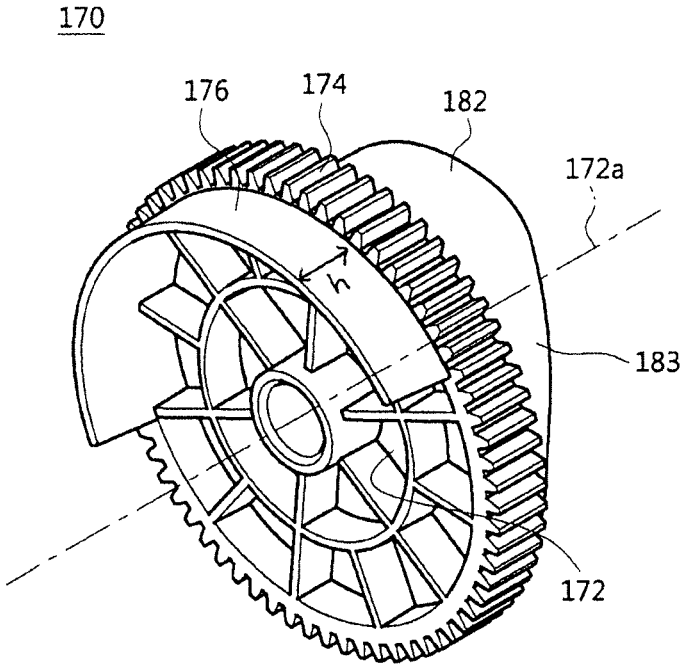
FIGS. 6A, 6B, and 6C are views illustrating a cam gear according to the first embodiment of the present invention.
Figure 6B:
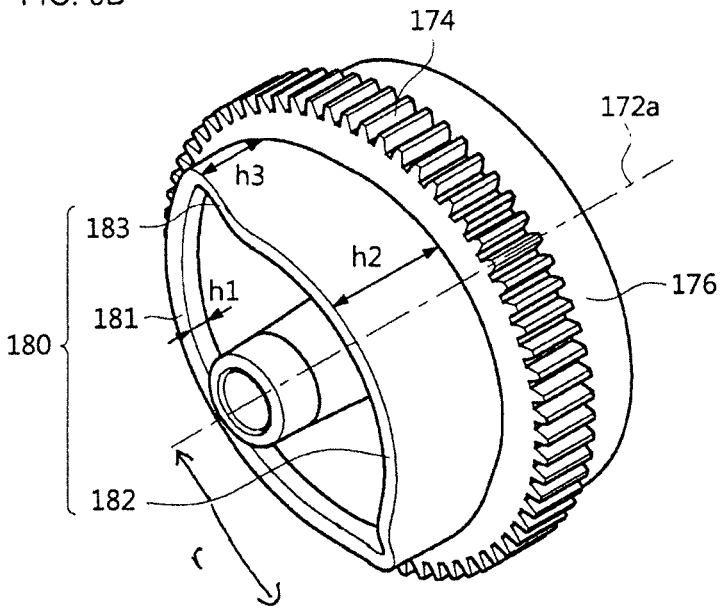
Figure 6C:
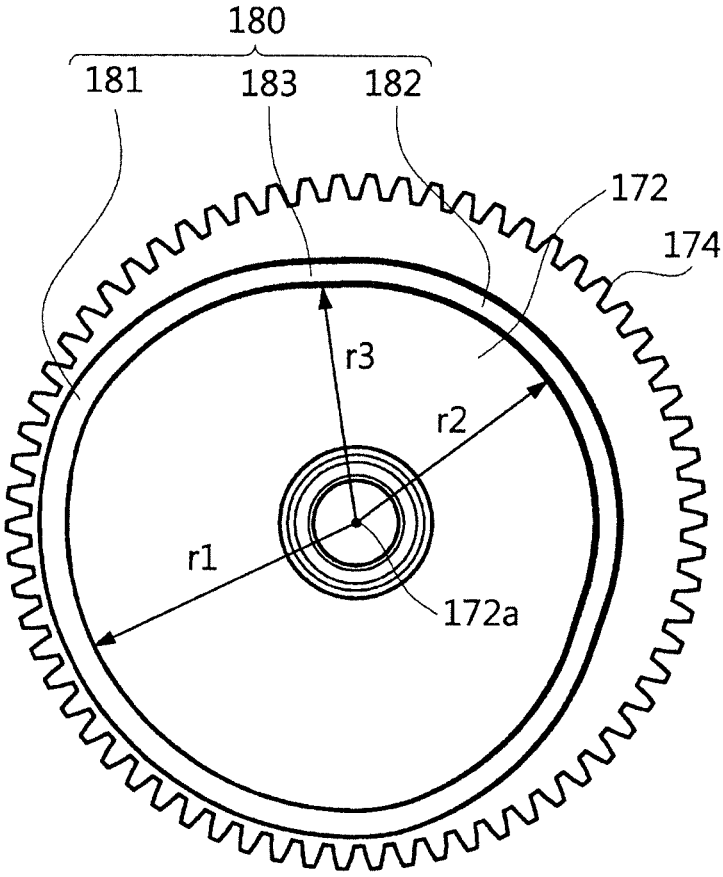

FIGS. 6A, 6B, and 6C are views illustrating the cam gear according to the first embodiment of the present invention.

The cam gear 170 is provided to receive a driving force from the driving part 162 to operate the shutter 140. The cam gear 170 is provided to convert a rotational motion generated from the driving part 162 into a reciprocating motion of the shutter 140. That is, the cam gear 170 is provided to convert a rotating force into movement of the shutter 140 for opening and closing the window 122.

The cam gear 170 includes a gear body 172, a worm wheel 174 for rotating the gear body 172 interlocked with the above described worm 164, and the cam rail 180 which is provided on one side of the gear body 172 and operates the shutter 140.

The gear body 172 is provided to be capable of rotating about a rotation axis 172*a*, and rotatable through a driving force transmitted to the worm wheel 174. A shape of the gear body 172 is not limited, and the shape is provided to be roughly formed in a cylindrical shape.

The cam rail 180 is in contact with one side of the shutter 140 so that the shutter 140 is movable based on the rotation of the cam gear 170. In detail, while a guide pole 146 formed to protrude from the shutter 140 to the cam gear 170 moves along the cam rail 180, the shutter 140 is movable between the first position P1 and the second position P2. A thickness of the cam rail 180 is not limited.

The cam rail 180 may change a radial distance r from a center of the rotation axis 172*a* of the cam gear 170 to the cam rail 180 according to a rotation angle of the cam gear 170. That is, a distance between an arbitrary point of the cam rail 180 and the rotation axis 172*a* of the cam gear 170 may vary according to the rotation angle of the cam gear 170.

According to the above configuration, the guide pole 146 of which movement is restricted by the cam rail 180 may be moved according to displacement in the first direction W1 by the rotation of the cam gear 170. That is, since the cam gear 170 performs a rotational motion, the guide pole 146, which moves along the cam rail 180 and reciprocates in the same plane, is moved and a radial distance r changes.

That is, the shutter 140 is positioned at the first position P1 when a radial distance of the cam rail 180 along which the guide pole 146 is guided is r1, the shutter 140 is positioned at the second position P2 when a radial distance of the cam rail 180 along which the guide pole 146 is guided is r2, and r1 is formed to be greater than r2.

The cam rail 180 includes a first cam rail 181 and a second cam rail 182.

The first cam rail 181 and the second cam rail 182 may be formed in a circular arc shape about the rotation axis 172*a* of the cam gear 170. The first cam rail 181 and the second cam rail 182 may be formed to have r1 and r2 radii, respectively. r1 is formed to be greater than r2, and the first cam rail 181 and the second cam rail 182 may be formed to face each other.

The guide pole 146 is moved along the first cam rail 181 and the second cam rail 182 according to rotation of the cam gear 170, and thus the shutter 140 is also moved to the first position P1 and the second position P2. That is, when the guide pole 146 is restricted by the first cam rail 181, the shutter 140 may be positioned at the first position P1 at which the window 122 is closed, and when the guide pole 146 is restricted by the second cam rail 182 by rotating the cam gear 170, the shutter 140 may be positioned at the second position P2 at which the window 122 is opened. The guide pole 146 may be formed to protrude from the shutter body 142 in the second direction W2 to be movable along the cam rail 180.

The above shutter 140 reciprocates according to displacement in the first direction W1 as much as a difference between the radius r1 of the first cam rail 181 and the radius r2 of the second cam rail 182.

Since the shutter 140 reciprocates according to the displacement in the first direction W1, movement of the shutter 140 may be smaller than that of a case in which the shutter 140 reciprocates only in the second direction W2. Furthermore, since the shutter 140 moves based on the first direction W1 component to open and close the sensor 112, the shutter 140 does not need a hole through which light of the sensor 112 passes, and the sensor 112 can be efficiently protected from an external environment.

The cam rail 180 includes a third cam rail 183 which connects the first cam rail 181 and the second cam rail 182. The third cam rail 183 may be formed to have a radius r3 smaller than r1 and greater than r2. Since the third cam rail 183 is formed to connect the first cam rail 181 and the second cam rail 182, a radius may be formed to vary at each point. r3 and r1 have similar values at a point adjacent to the first cam rail 181, and r3 and r2 have similar values at a point adjacent to the second cam rail 182.

The shutter 140 may move based on the second direction W2 component as well as the first direction W1 component.

The cam rail 180 may be formed to change a height h in an axial direction of the cam gear 170 according to a rotation angle of the cam gear 170. That is, a height h from the gear body 172 to an end portion of the cam rail 180 may be formed to vary at an arbitrary point of the cam rail 180 based on the rotation angle of the cam gear 170.

According to the above configurations, the guide pole 146 of which movement is restricted by the cam rail 180 according to rotation of the cam gear 170 may move according to displacement in the second direction W2. That is, since the cam gear 170 performs a rotational motion, the guide pole 146, which moves along the cam rail 180 and reciprocates in the same plane, performs a linear motion by which a height h in an axial direction changes.

That is, the shutter 140 is positioned at the first position P1 when a radial distance of the cam rail 180 along which the guide pole 146 is guided is r1 and a height in an axial direction is h1, the shutter 140 is positioned at the second position P2 when a radial distance of the cam rail 180 along which the guide pole 146 is guided is r2 and a height in an axial direction is h2, and r1 is formed to be greater than r2 and h2 is formed to be greater than h1.

The first cam rail 181 and the second cam rail 182 may be formed to have heights h1 and h2, respectively. h2 is formed to be greater than h1. That is, the first cam rail 181 may be formed to extend and be longer in an axial direction of the cam gear 170 from the shutter body 142 than the second cam rail 182.

The guide pole 146 is moved along the first cam rail 181 and the second cam rail 182 according to rotation of the cam gear 170, and thus the shutter 140 is also moved to the first position P1 and the second position P2. That is, the shutter 140 is positioned at the first position P1 at which the window 122 is closed when the guide pole 146 is restricted by the first cam rail 181, and the shutter 140 is positioned at the second position P2 at which the window 122 is opened when the guide pole 146 is restricted by the second cam rail 182 by rotating the cam gear 170.

The above shutter 140 reciprocates according to displacement in the first direction W1 as much as a difference between the radius r1 of the first cam rail 181 and the radius r2 of the second cam rail 182, and reciprocates according to displacement in the second direction W2 as much as a difference between the height h1 of the first cam rail 181 and the height h2 of the second cam rail 182. That is, the shutter 140 performs oblique movement with the first direction W1 component and the second direction W2 component. That is, the shutter 140 performs oblique movement with respect to the first direction W1 and the second direction W2.

The third cam rail 183 may be formed to have a height h3 greater than h1 and smaller than h2. Since the third cam rail 183 is formed to connect the first cam rail 181 and the second cam rail 182, a height may be formed to vary at each point, h3 and h1 may have similar values at a point adjacent to the first cam rail 181, and h3 and h2 may have similar values at a point adjacent to the second cam rail 182.

In the embodiment of the present invention, the shutter driving device 160 is disposed on one end of the shutter 140 so that the shutter 140 moves between the first position P1 and the second position P2. Since the shutter 140 is disposed in a long shape in the second direction W2, a driving force of the shutter driving device 160 acting on the one end of the shutter 140 may not be transmitted to the other end of the shutter 140. Accordingly, the shutter driving device 160 moves in the second direction W2 as well as in the first direction W1, i.e., oblique movement, and thus the driving force may be transmitted to the other end of the shutter 140.

The cam gear 170 includes the detection part 176.

The detection part 176 is provided to detect a rotation angle of the cam gear 170 by the rotation angle detection sensor 190. The detection part 176 is formed as a rib in an arc shape having a predetermined radius and extending in a circumferential direction around the rotation axis 172*a* of the cam gear 170. Since the detection part 176 detects the rotation angle of the cam gear 170 by the rotation angle detection sensor 190, the shutter 140 may recognize a first set angle Θ1 of the cam gear 170 corresponding to the first position P1 in a state in which the window 122 is closed, and a second set angle 82 of the cam gear 170 corresponding to the second position P2 in a state in which the window 122 is opened. In the embodiment of the present invention, the detection part 176 is provided to correspond to the second cam rail 182 on a rear face of the second cam rail 182, and formed to have the second set angle Θ2. Thus, a rear face of the first cam rail 181 on which the detection part 176 is not disposed is formed to have the first set angle Θ1.

However, the present invention is not limited thereto, and the detection part 176 may be provided to correspond to the first cam rail 181 on the rear face of the first cam rail 181 to recognize the first set angle Θ1.

Figure 7A:
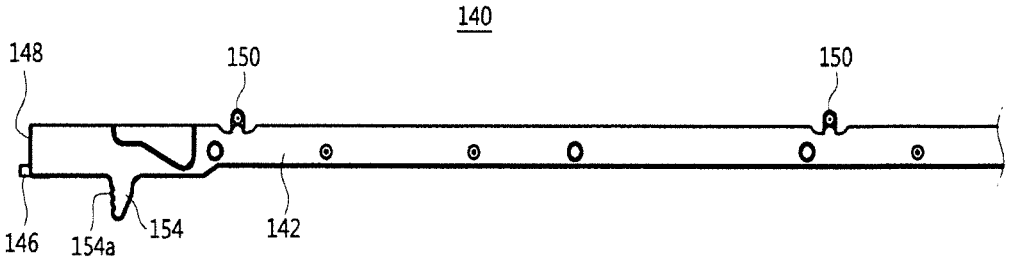
FIGS. 7A and 7B are views illustrating a shutter according to the first embodiment of the present invention.
Figure 7B:
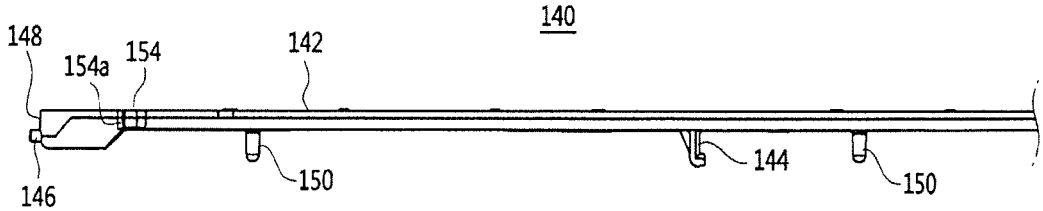
Figure 9:
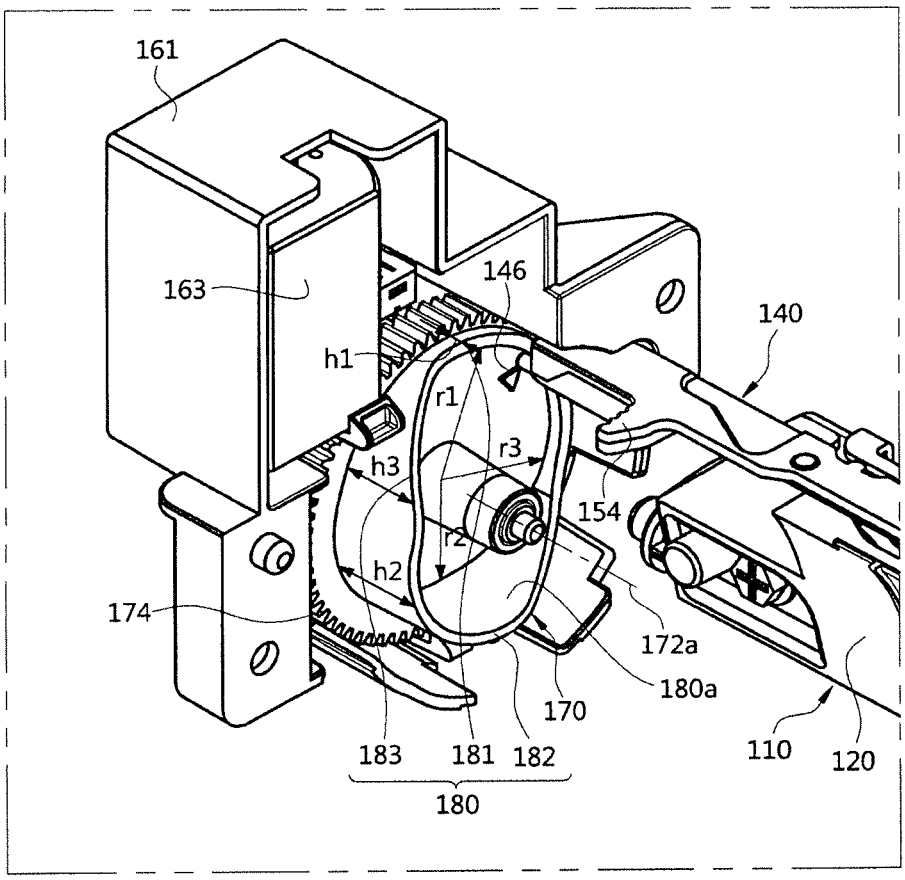
FIG. 9 is a view illustrating a sensing unit and a shutter device according to the first embodiment of the present invention.

FIGS. 7A and 7B are views illustrating a shutter according to the first embodiment of the present invention, FIG. 8 is an enlarged view illustrating a part of the shutter according to the first embodiment of the present invention, and FIG. 9 is a view illustrating a sensing unit and a shutter device according to the first embodiment of the present invention.

The shutter 140 is movably provided to open and close the window 122 of the sensing unit 110.

The shutter 140 may include a shutter body 142, a guide pole 146, and a shutter protrusion 150.

The shutter body 142 is formed in a long shape in the second direction W2 to correspond to an upper side of the sensing unit 110. That is, the shutter body 142 may be roughly provided in a rectangular shape having a longitudinal direction in the second direction W2. In the embodiment of the present invention, the shutter 140 has displacement of the first direction W1 component, and may move in a width direction of the shutter 140, thereby an additional hole may be not necessary for transferring light of the sensor 112.

In the embodiment of the present invention, when the shutter 140 is disposed at the first position P1, the shutter body 142 may be formed to entirely seal a surface located at the same level as the window 122 in the second direction W2 from the sensor housing 120. Accordingly, when the shutter 140 is disposed at the first position P1, the window 122 can be more efficiently protected from the outside.

The guide pole 146 is formed to extend and protrude from the shutter body 142 toward the shutter driving device 160. As described above, the guide pole 146 may be restricted by the cam rail 180, and the guide pole 146 is moved along the cam rail 180 by rotation of the cam gear 170, and thus the shutter 140 may be moved.

The guide pole 146 may be guided by the cam rail 180 to move along an inner surface 180*a* of the cam rail 180. A rail contact surface 148 in contact with the cam rail 180 is formed on one end of the shutter 140 on which the guide pole 146 is disposed. Since the rail contact surface 148 is provided to be in contact with one end of the cam rail 180, the guide pole 146 is stably guided by the cam rail 180.

Accordingly, the guide pole 146 is guided along the inner surface 180*a* of the cam rail 180 by rotation of the cam gear 170, and thus the shutter 140 reciprocates.

As described above, the shutter protrusion 150 may be provided to move the guide rail 124 of the sensor housing 120. At least one shutter protrusion 150 may be provided, and in the embodiment of the present invention, a plurality of shutter protrusions 150 are provided to be separated from each other in a longitudinal direction of the shutter 140.

The shutter protrusion 150 includes a protrusion inserting part 151 formed to extend from the shutter body 142 toward the sensor housing 120 to pass through the guide rail 124, and a protrusion supporting part 152 which is bent from the protrusion inserting part 151 to support a rear surface of the sensor housing 120 located at an upper side thereof. The protrusion inserting part 151 moves along the guide rail 124 to guide movement of the shutter 140, and the protrusion supporting part 152 is provided on the sensor housing 120 to restrict the shutter 140 so that the shutter 140 is not detached from the sensor housing 120.

According to the above configuration, when a third direction W3 refers to a direction perpendicular to the first direction W1 and the second direction W2 of the shutter 140, the shutter 140 may be provided to be moved in the first direction W1 and the second direction W2 by the cam gear 170, but movement thereof may be restricted in the third direction W3 because the shutter protrusion 150 is restricted by the guide rail 124. That is, it can prevent detachment of the shutter 140 from the sensor housing 120.

The shutter 140 may include the hook protrusion 144. As described above, the hook protrusion 144 is provided to hook the other end of the elastic restoring member 127, and formed to protrude from a lower surface of the shutter body 142. According to the above configuration, since one end of the elastic restoring member 127 is connected to the sensor housing 120 and the other end hooks the hook protrusion 144, the shutter 140 is provided to be elastically supported.

Figure 10A:
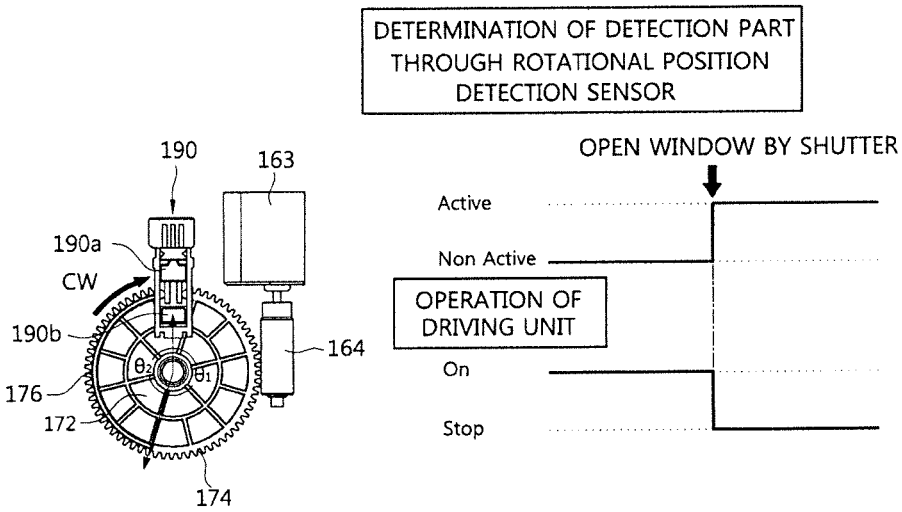
FIGS. 10A and 10B are views illustrating a relationship between a rotational position detection sensor and a detection part and an operation of the shutter according to the first embodiment of the present invention.
Figure 10B:
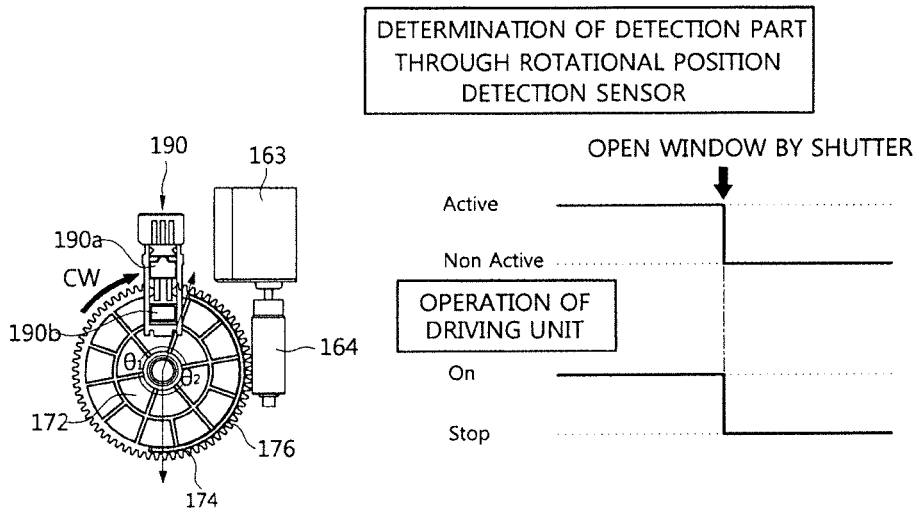

FIGS. 10A and 10B are views illustrating a relationship between a rotational position detection sensor and a detection part and an operation of the shutter according to the first embodiment of the present invention.

When a developer disposed on the transfer member 51 does not need to be inspected, a state in which the window 122 of the sensor 112 is closed by the shutter 140 is maintained.

Even when the developer is detached from the transfer member 51 in the above state, the developer is accumulated only on the shutter 140 and hardly transferred to the sensor 112, and thus contamination of the sensor 112 is prevented.

When the developer disposed on the transfer member 51 is required to be inspected, the driving motor 163 is operated and the worm 164 and the cam gear 170 are rotated. The cam rail 180 provided on the cam gear 170 moves the shutter 140 from the first position P1 to the second position P2 according to rotation of the cam gear 170 so that the window 122 is opened.

Rotation of the cam gear 170 with a second set angle Θ2 is detected according to whether the detection part 176 is positioned between the light emitting part 190*a* and the light receiving part 190*b* of the rotational position detection sensor 190, when rotation of the cam gear 170 with a first set angle Θ1 is detected by the rotational position detection sensor 190, the operation of the driving motor 163 stops.

Rotation of the worm 164, the worm wheel 174 interlocked with the worm 164, and the cam gear 170 stops according to the stopping of the operation of the driving motor 163, and a state in which the cam rail 180 presses the shutter 140 at the second position P2 is maintained. Thus, a state in which the window 122 corresponding to the sensor 112 is opened may be continuously maintained.

After the developer disposed on the transfer member 51 is inspected, the driving motor 163 is operated again and the worm 164 and the worm wheel 174 interlocked with the worm 164, and the cam gear 170 are rotated. The cam rail 180 which restricts the shutter 140 by the rotation of the cam gear 170 is shifted from the second cam rail 182 to the first cam rail 181, pressure by the second cam rail 182 is released, and the shutter 140 is moved from the second position P2 to the first position P1 by the elastic restoring member 127.

As the shutter 140 returns to the first position P1, the window 122 corresponding to the sensor 112 is closed by the shutter 140. When rotation of the cam gear 170 with the first set angle Θ1 is detected by the detection part 176 and the rotational position detection sensor 190 in the above state, the operation of the driving motor 163 stops. That is, since the detection part 176 exists only at the second set angle Θ2, the operation of the driving motor 163 stops when light of the light emitting part 190*a* is transmitted to the light receiving part 190*b* without influence by the detection part 176.

Rotation of the worm 164, the worm wheel 174 interlocked with the worm 164, and the cam gear 170 stops according to the stopping of the operation of the driving motor 163, and a state in which the cam rail 180 guides the shutter 140 to the first position P1 is maintained. Thus, a state in which the window 122 corresponding to the sensor 112 is closed may be continuously maintained.

As described above, since the window 122 corresponding to the sensor 112 is opened only when the sensor 112 inspects the developer disposed on the transfer member 51, the contamination of the sensing unit 110 is reduced, and thus a cleaning cycle of the sensing unit 110 can be increased.

Hereinafter, in the image forming apparatus based on the above configuration, an operation of the shutter device 130 will be described.

Figure 11A:
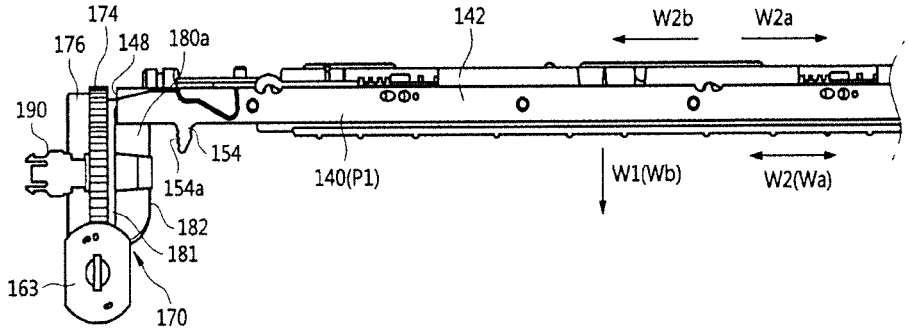
FIGS. 11A and 11B are views illustrating an operation of the sensing assembly according to the first embodiment of the present invention.
Figure 11B:
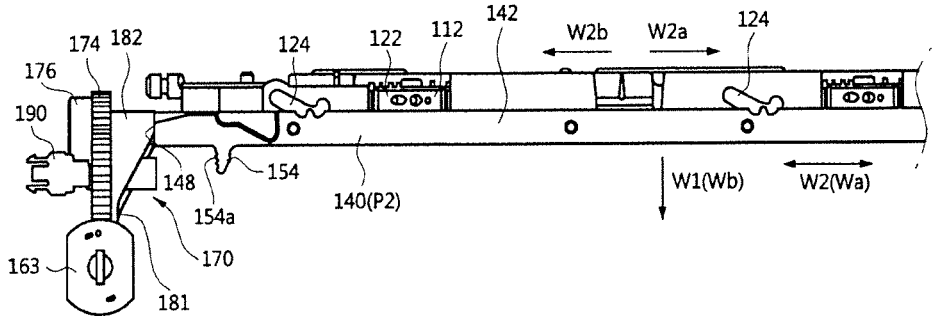

FIGS. 11A and 11*b* are views illustrating an operation of the sensing assembly according to the first embodiment of the present invention.

As described above, the rotational position detection sensor 190 senses the detection part 176 according to the rotation of the cam gear 170, and is provided to maintain a state in which the shutter 140 is positioned at the first position P1 or second position P2.

At the first position P1 at which the shutter 140 closes the window 122, the guide pole 146 of the shutter 140 is guided by the first cam rail 181 of the cam gear 170.

In the above state, the cam gear 170 is rotated by an operation of the driving part 162, the guide pole 146 of the shutter 140 is guided by the cam rail 180 of the cam gear 170, and the guidance of the cam rail 180 turns from the first cam rail 181 to the second cam rail 182. When the guide pole 146 is guided by the second cam rail 182, the shutter 140 is positioned at the second position P2 at which the window 122 is opened.

Since the first cam rail 181 is separated r1 from a center of the cam gear 170 in a radial direction and has a height h1 from the gear body 172, and the second cam rail 182 is separated r2 smaller than r1 from the center of the cam gear 170 in the radial direction and has a height h2 greater than h1 from the gear body 172, the shutter 140 moves in the first direction W1 as much as a difference between r1 and r2, and moves in the second direction W2 as much as a difference between h1 and h2.

While the shutter 140 moves from the first position P1 to the second position P2, the shutter protrusion 150 may be provided to be guided by the guide rail 124 of the sensor housing 120 so that the shutter body 142 performs parallel movement.

In this process, when the rotational position detection sensor 190 detects the detection part 176, an operation of the driving part 162 stops, rotation of the cam gear 170 stops, and a state in which the shutter 140 is positioned at the second position P2 is maintained.

Then, when the driving part 162 is operated again, the cam gear 170 is rotated, the guide pole 146 of the shutter 140 is guided by the cam rail 180 of the cam gear 170, and the guidance of the cam rail 180 turns from the second cam rail 182 to the first cam rail 181. When the guide pole 146 is guided by the first cam rail 181, the shutter 140 is positioned at the first position P1 at which the window 122 is closed.

While the shutter 140 moves from the second position P2 to the first position P1, the shutter protrusion 150 may be provided to be guided by the guide rail 124 of the sensor housing 120 so that the shutter body 142 performs parallel movement.

In this process, when the rotational position detection sensor 190 detects that the detection part 176 does not exist, the operation of the driving part 162 stops, the rotation of the cam gear 170 stops, and the shutter 140 is maintained in a state at the first position P1.

Hereinafter, a view is related to an operation of the sensing assembly according to opening and closing the side cover.

Figure 12A:
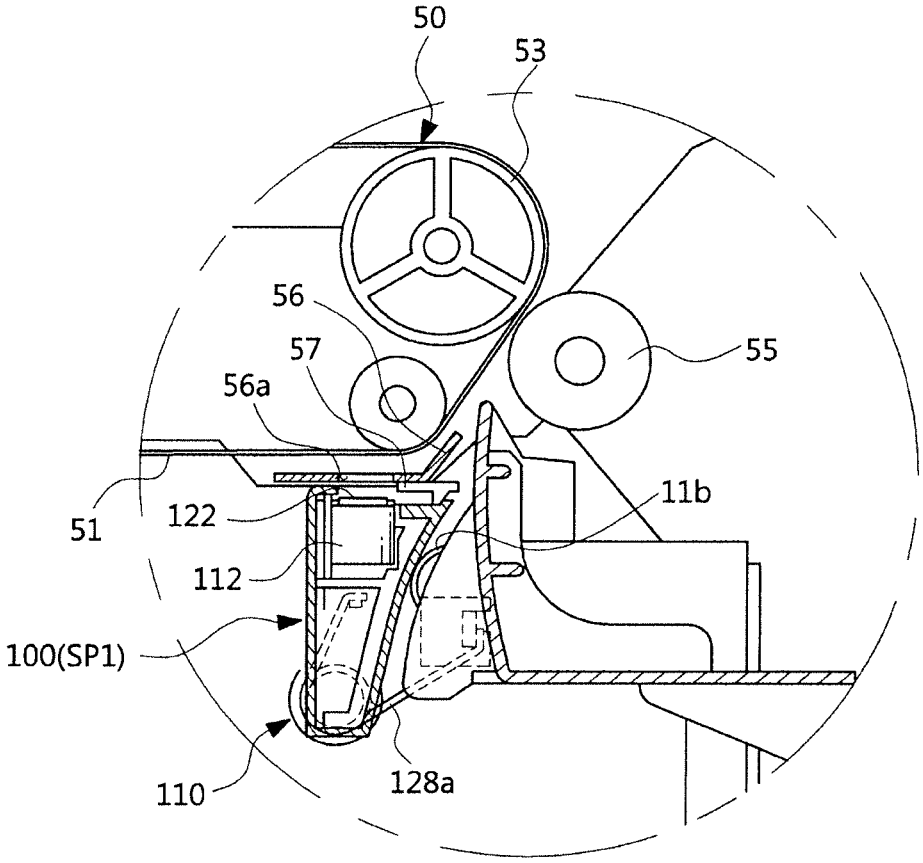
FIGS. 12A and 12B are views illustrating an operation of the sensing assembly based on a side cover according to the first embodiment of the present invention.
Figure 12B:
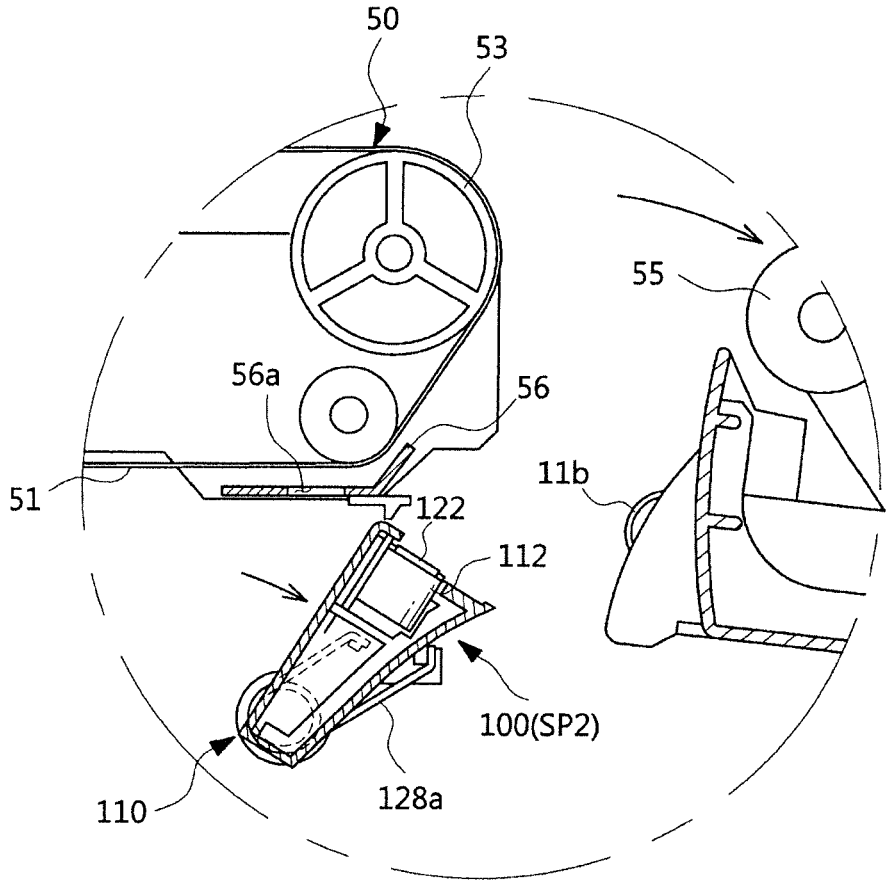

FIGS. 12A and 12B are views illustrating an operation of the sensing assembly based on a side cover according to the first embodiment of the present invention.

The shutter 140 may include a manual open/close protrusion 154.

The manual open/close protrusion 154 is formed to protrude from the shutter body 142, and provided to manually press the shutter 140 so that the window 122 is exposed to the outside. The manual open/close protrusion 154 may be provided on the shutter body 142, and formed to protrude in the first direction W1 to press in the second direction W2. A grip surface 154*a* in a bent shape may be formed on one side surface of the manual open/close protrusion 154 to facilitate gripping.

As the manual open/close protrusion 154 is pressed, the shutter 140 may be moved from the first position P1 at which the window 122 is closed, to the second position P2 at which the window 122 is opened. When the pressure on the manual open/close protrusion 154 is released, the shutter 140 is returned from the second position P2 to the first position P1 by the elastic restoring member 127.

To manually open and close the shutter device 13*o*, the sensing assembly 100 may be operated in linkage with the side cover.

That is, the sensing assembly 100 in linkage with an open and close operation of the side cover is provided to be positioned at a first set location SP1 at which an upper side of the sensing assembly 100 is opposite an intermediate transfer belt, and a second set location SP2 at which the upper side of the sensing assembly 100 is exposed to the opening 10*c*.

In a state in which the opening 10C is closed by the side cover 11, a state, in which a sensor unit 90 is elastically supported by a supporting member 11*b* so that the window 122 of the sensing unit 110 is positioned at the first set location SP1 opposite the transfer member 51 through the through-hole 56*a*, is maintained.

In a state in which the opening 10C is closed by the side cover 11, the sensing assembly 100 may be positioned at the first set location SP1 to sense the developer disposed on the transfer member 51 through the window 122, and in a state in which the opening 10C is opened by the side cover 11, the sensing assembly 100 is provided to be positioned at the second set location SP2 to be exposed to the outside so that a user may manually operate the shutter 140. According to the process, the user may press the manual open/close protrusion 154 of the shutter 140 and the window 122 exposed to the outside may be cleaned.

As described above, to move the upper side of the sensing assembly 100 from the first set location SP1 to the second set location SP2, the sensing assembly 100 is rotatably installed inside the main body 10, and the supporting member 11*b*, which protrudes to an inner side of the opening 10*c* to elastically support the sensing assembly 100 so that the sensing assembly 100 is rotated, is disposed on the side cover 11.

Hinge parts 128, which may rotatably install the sensing assembly 100 inside the main body, each protrude from the sensor housing 120 in both side directions. Further, an elastic member 128*a* is installed on at least one of the two hinge parts 128 so that the sensing assembly 100 is rotated by elastically supporting the sensing unit 110. The elastic member 128*a* may be provided with a torsion spring.

In a state in which the sensing assembly 100 is not pressed by the supporting member 11*b*, the sensing assembly 100 is rotated by an elastic restoring force of an elastic member 128*a* so that the sensing assembly 100 is moved to the second set location SP2.

Hereinafter, an image forming apparatus according to a second embodiment will be described.

In the below description, the description of configurations duplicated with those of the above described embodiment will be omitted.

Figure 13:
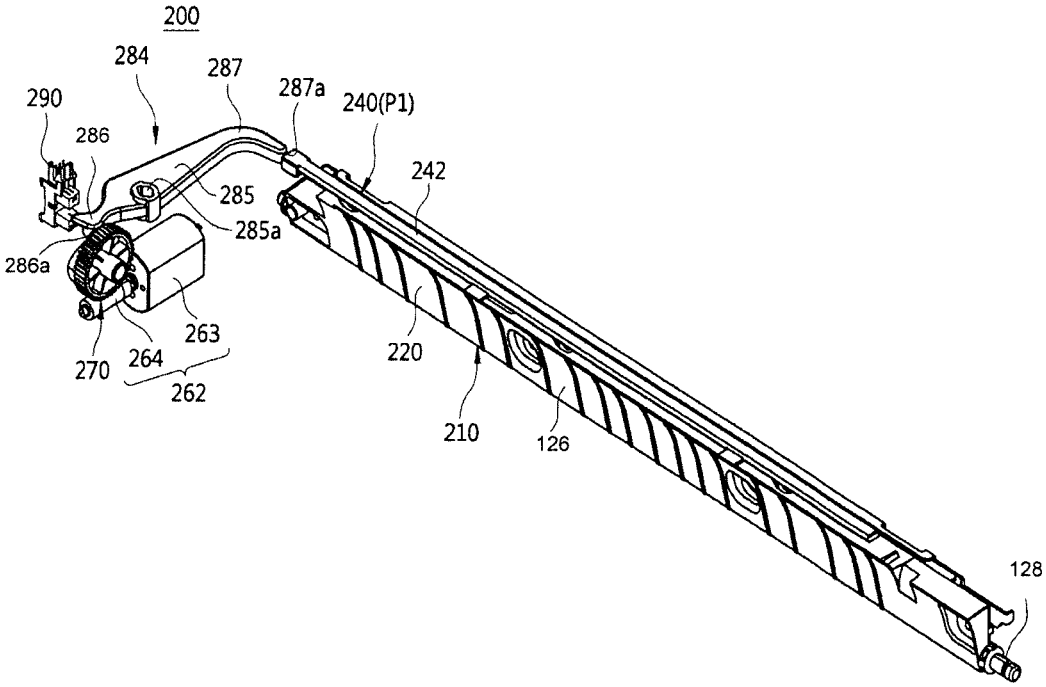
FIG. 13 is a perspective view of a sensing assembly according to a second embodiment of the present invention.
Figure 14:
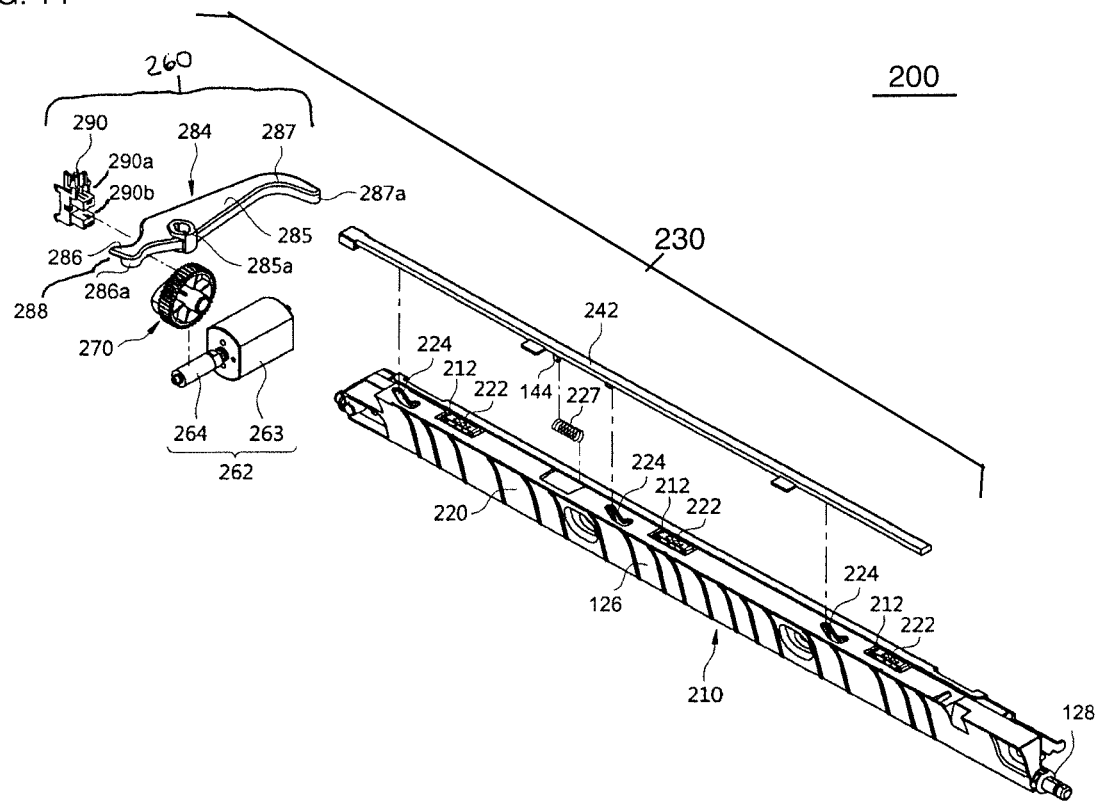
FIG. 14 is an exploded perspective view of the sensing assembly according to the second embodiment of the present invention.
Figure 15A:
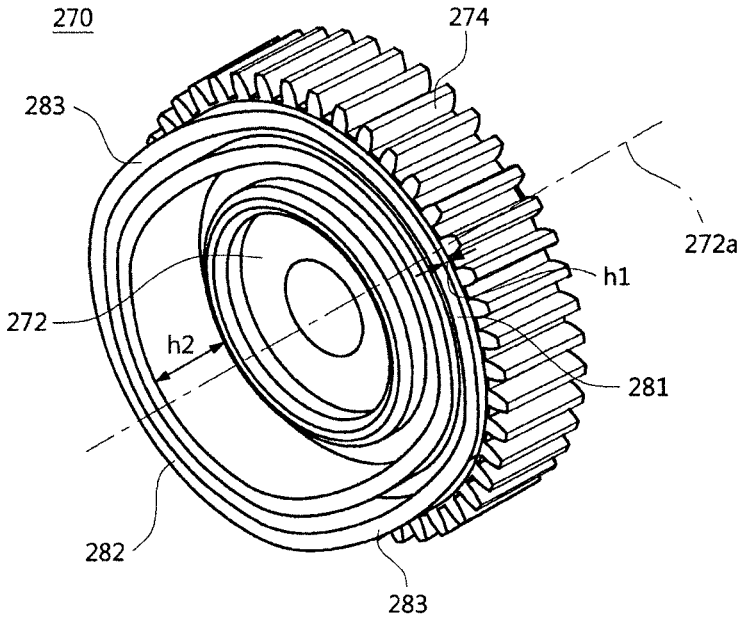
FIGS. 15A and 15B are perspective views of a cam gear according to the second embodiment of the present invention.
Figure 15B:
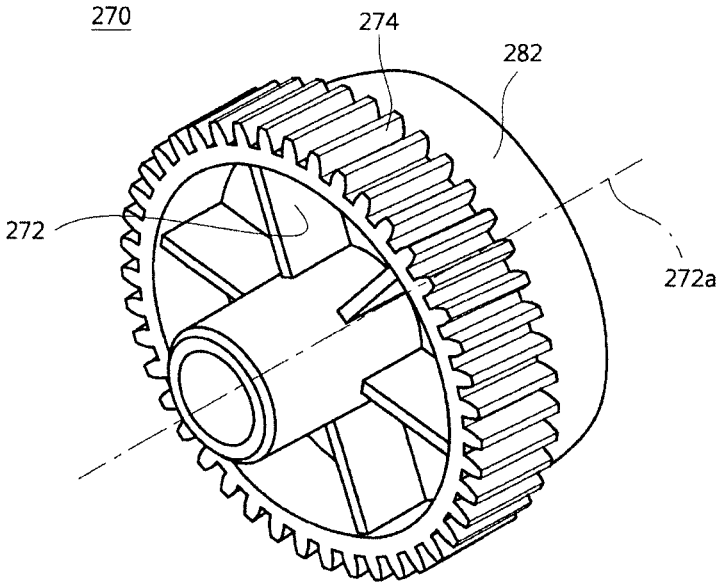

FIG. 13 is a perspective view of a sensing assembly according to a second embodiment of the present invention, FIG. 14 is an exploded perspective view of the sensing assembly according to the second embodiment of the present invention, and FIGS. 15A and 15B are perspective views of a cam gear according to the second embodiment of the present invention.

A sensing assembly 200 includes a sensing unit 210 and a shutter device 230 provided to selectively open and close the sensing unit 210.

The sensing unit 210 is provided to inspect a developer disposed on the transfer member 51.

The sensing unit 210 includes a plurality of sensors 212 which inspect the developer disposed on the transfer member 51 and a sensor housing 220 in which the plurality of sensors 212 are accommodated and installed.

The shutter device 230 includes a shutter 240 and a shutter driving device 260.

The shutter driving device 260 is provided so that the shutter 240 is movable. The shutter driving device 260 includes a driving part 262, a cam gear 270, and a lever 284.

The driving part 262 includes a worm 264 and a driving motor 263.

The cam gear 270 includes a gear body 272, a worm wheel 274 rotatably providing the gear body 272 interlocked with the worm 264 of the driving part 262, and a cam rail 280 provided on one side of the gear body 272 to operate the shutter 240.

The gear body 272 is provided to be capable of rotating about a rotation axis 272*a*, and rotated by a driving force transferred from the worm wheel 274. The shape of the gear body 272 is not limited, and the shape may be roughly formed in a cylindrical shape.

The cam rail 280 is provided to be in contact with one end of the lever 284, and rotatably provides the lever 284 is according to rotation of the cam gear 270. The lever 284 is rotated about a lever rotational part 285*a* according to the rotation of the cam gear 270 so that the shutter 240 is moved from the first position P1 and the second position P2.

The cam rail 280 may be formed to change a height h in an axial direction of the cam gear 270 based on a rotation angle of the cam gear 270. That is, the cam rail 280 may be formed to have a different height h from the gear body 272 to an end portion of the cam rail 280 at an arbitrary point of the cam rail 280 based on the rotation angle of the cam gear 270.

According to the above configuration, the lever 284 may be rotated about the lever rotational part 285*a* according to rotation of the cam gear 270. That is, since the cam gear 270 performs a rotational motion, the lever 284 rotated by the cam rail 280 presses the shutter 240, and thus the shutter 240 moves according to displacement in the first direction W1 and the second direction W2. In other words, the lever 284 presses the shutter 240 to move the shutter 240 between the first position P1 and the second position P2 based on a change in the height h in the axial direction of the cam gear 270.

The cam rail 280 includes a first cam rail 281 and a second cam rail 282.

The first cam rail 281 and the second cam rail 282 may each be formed in a shape of a circular arc based on the rotation axis 272*a* of the cam gear 270. The first cam rail 281 and the second cam rail 282 may be formed to have the same radius from a center of the cam gear 270, and provided to face each other.

The first cam rail 281 and the second cam rail 282 may be formed to respectively have heights h1 and h2. h2 may be formed to be greater than h1.

That is, the shutter 240 is positioned at the first position P1 when a height in an axial direction of the cam gear 270 in contact with the lever 284 is h1, the shutter 240 is positioned at the second position P2 when a height in an axial direction of the cam gear 270 in contact with the lever 284 is h2, and h2 may be formed to be greater than h1.

The lever 284 is provided to receive a rotating force from the cam gear 270 to transmit the rotating force to the shutter 240.

One end of the lever 284 is in contact with the cam gear 270 and receives a rotating force by rotation of the cam gear 270, and the other end of the lever 284 is in contact with the shutter 240 and presses the shutter 240 to move the shutter 240 from the first position P1 to the second position P2.

Since movement of the lever 284 at the other end thereof is a trajectory traced in an arc shape, the other end of the lever 284 and one end of the shutter 240 are fixed to obliquely move the shutter 240 based on displacement in the first direction W1 and displacement in the second direction W2. In the embodiment of the present invention, the other end of the lever 284 and the shutter 240 are formed to be in contact with each other in the second direction W2, and thus pressure from the other end of the lever 284 in the second direction W2 is transmitted to the other end of the shutter 240.

The cam rail 280 may include a third cam rail 283 which connects the first cam rail 281 and the second cam rail 282.

The lever 284 includes a lever body 285, a pressurized part 286, a pressing part 287, and the lever rotational part 285*a*.

The lever body 285 is provided to be capable of rotating about the lever rotational part 285*a*, and may be roughly provided in a bar shape having a long length.

The pressurized part 286 is provided on one end of the lever body 285 based on the lever rotational part 285*a*, and the pressing part 287 may be provided on the other end of the lever body 285 based on the lever rotational part 285*a*.

The pressurized part 286 has a pressurized surface 286*a* in contact with the cam rail 280. The pressurized surface 286*a* may rotate the lever 284 while the contact of the cam rail 280 turns from the first cam rail 281 to the second cam rail 282 or from the second cam rail 282 to the first cam rail 281.

The pressing part 287 has a pressure surface 287*a* in contact with one end of the shutter 240. As described above, movement of the pressing part 287 at an end portion thereof may be a trajectory traced in an arc shape.

By operations of the cam gear 270 and the lever 284, the shutter 240 reciprocates between the first position P1 and the second position P2. The pressing part 287 of the lever 284 and one end of the shutter 240 are fixed, and thus the shutter 240 may be moved from the first position P1 to the second position P2 by rotation of the lever 284, and be returned from the second position P2 to the first position P1. In the embodiment of the present invention, the pressing part 287 of the lever 284 and one end of the shutter 240 are not fixed, pressure is transmitted by the pressing part 287 of the lever 284, and thus the shutter 240 is moved from the first position P1 to the second position P2, and the shutter 240 is returned from the second position P2 to the first position P1 by an elastic force of an elastic restoring member 227.

The lever 284 includes a detection part 288.

The detection part 288 is provided to detect a rotation angle of the lever 284 by the rotation angle detection sensor 290. The detection part 288 may be formed to protrude from the lever body 285.

Since the detection part 288 is detected by the rotation angle detection sensor 290, a first rotational position RP1 of the lever 284 corresponding to the first position P1 in a state in which the shutter 240 closes the window 222, and a second rotational position RP2 of the lever 284 corresponding to the second position P2 in a state in which the shutter 240 opens the window 222, may be recognized. In the embodiment of the present invention, the detection part 288 is interposed between a light emitting part 290*a* and a light receiving part 290*b* to block light when the lever 284 is positioned at the first rotation angle, and when the lever 284 is positioned at the second rotation angle, the detection part 288 is separated from the rotation angle detection sensor 290 and does not block the light.

As described with the first embodiment, a rotational position detection sensor 290 may sense the detection part 288, and a state in which the shutter 240 is positioned at the first position P1 or second position P2 may be maintained.

Hereinafter, an operation of the sensing assembly 200 according to the above configuration will be described.

Figure 16A:
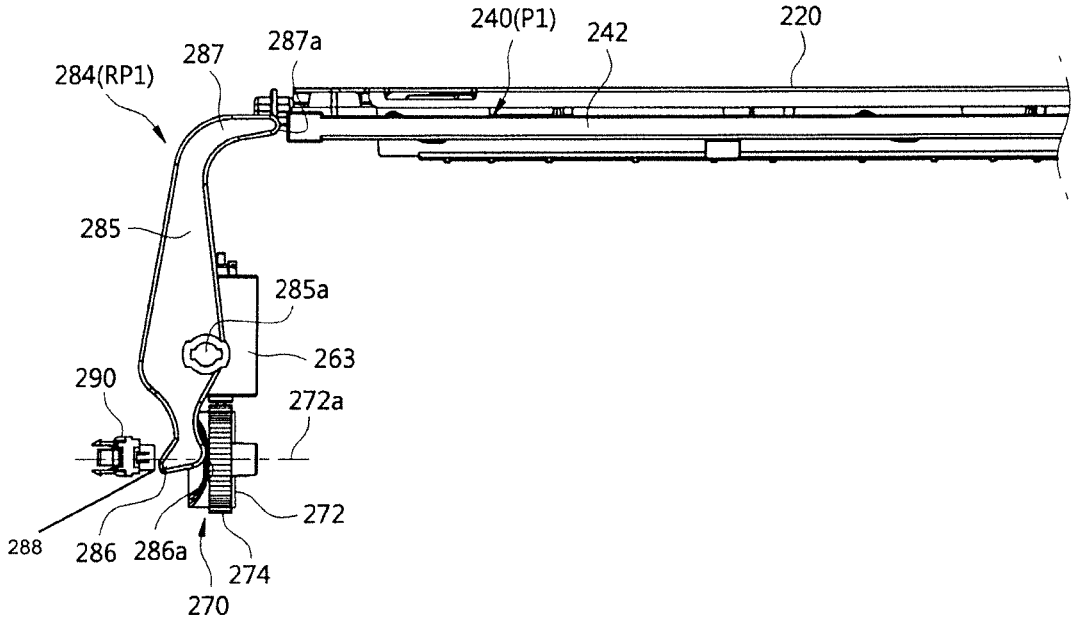
FIGS. 16A and 16B are views illustrating an operation of the sensing assembly according to the second embodiment of the present invention.
Figure 16B:
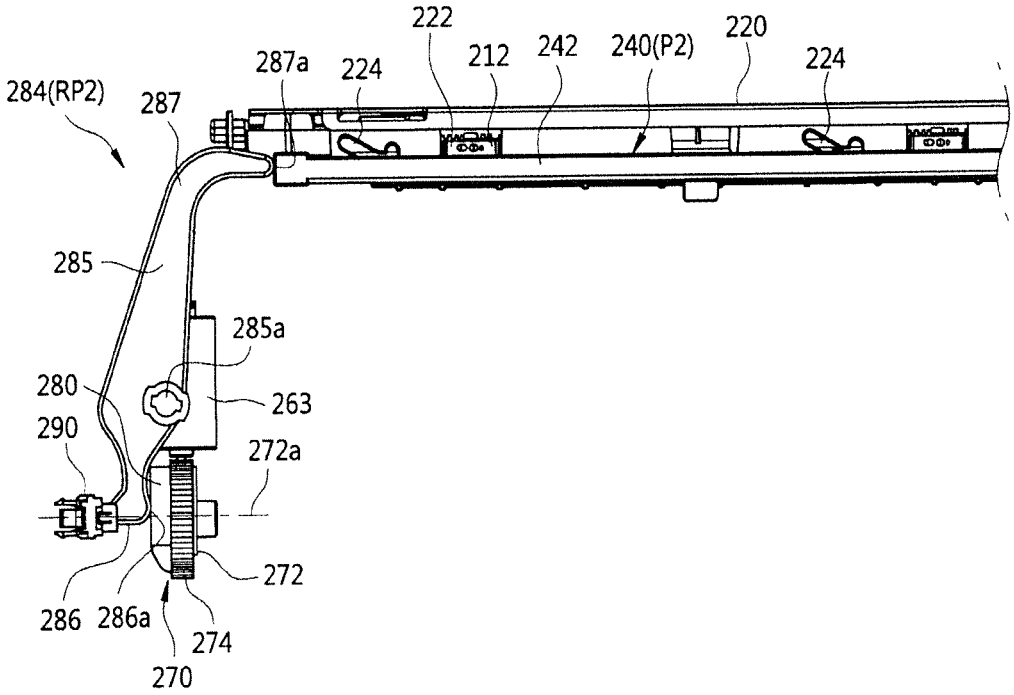

FIGS. 16A and 16B are views illustrating an operation of the sensing assembly according to the second embodiment of the present invention.

At the first position P1 at which the shutter 240 closes the window 222, the pressurized surface 286*a* of the lever 284 is guided by the first cam rail 281 of the cam gear 270.

In the above state, the cam gear 270 is rotated by an operation of the driving part 262, the pressurized part 286 of the lever 284 is guided by the cam rail 280 of the cam gear 270, and the guidance of the cam rail 280 turns from the first cam rail 281 to the second cam rail 282. When the pressurized part 286 is guided by the second cam rail 282, the pressing part 287 presses the shutter 240 to move from the first position P1 to the second position P2.

While the shutter 240 moves from the first position P1 to the second position P2, a shutter protrusion 250 may be provided to be guided by the guide rail 224 of the sensor housing 220 so that the shutter body 242 performs parallel movement.

In this process, when the rotational position detection sensor 290 detects the detection part 288 of the lever 284, an operation of the driving part 262 stops, rotation of the cam gear 270 stops, and the lever 284 maintains the second rotation angle.

Then, when the driving part 262 is operated again, the cam gear 270 is rotated, the pressurized part 286 of the lever 284 is guided by the cam rail 280 of the cam gear 270, and the guidance of the cam rail 280 turns from the second cam rail 282 to the first cam rail 281. When the lever 284 is guided by the first cam rail 281, the shutter 240 is positioned at the first position P1 at which the window 222 is closed.

While the shutter 240 moves from the second position P2 to the first position P1, the shutter protrusion 250 may be provided to be guided by the guide rail 224 of the sensor housing 220 so that the shutter body 242 performs parallel movement.

In this process, when the rotational position detection sensor 290 detects that the detection part 288 does not exist, the operation of the driving part 262 stops, the rotation of the cam gear 270 stops, and the lever 284 maintains the first rotation angle and the shutter 240 maintains in a state at the first position P1.

Hereinafter, an image forming apparatus according to a third embodiment will be described.

In the below description, the description of configurations duplicated with those of the above described embodiments will be omitted.

Figure 17:
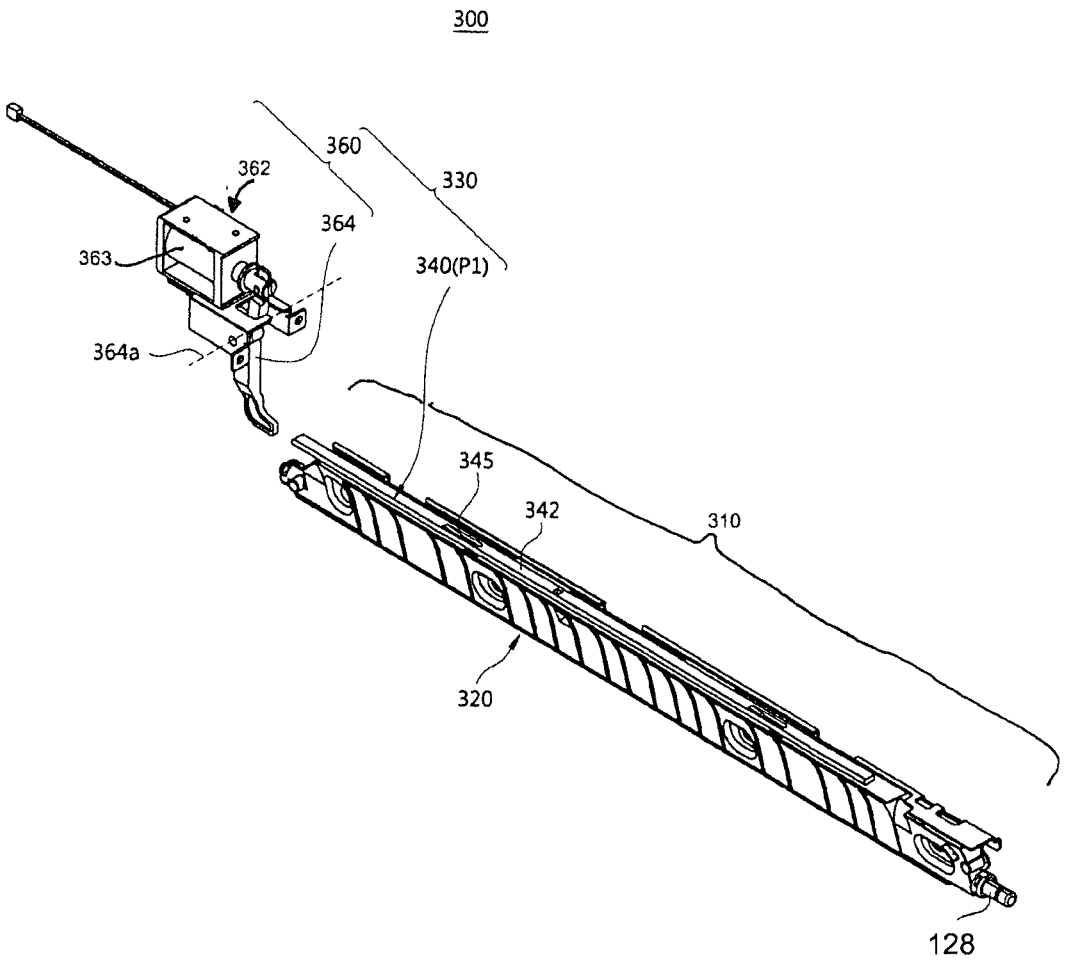
FIG. 17 is a perspective view of a sensing assembly according to a third embodiment of the present invention.
Figure 18:
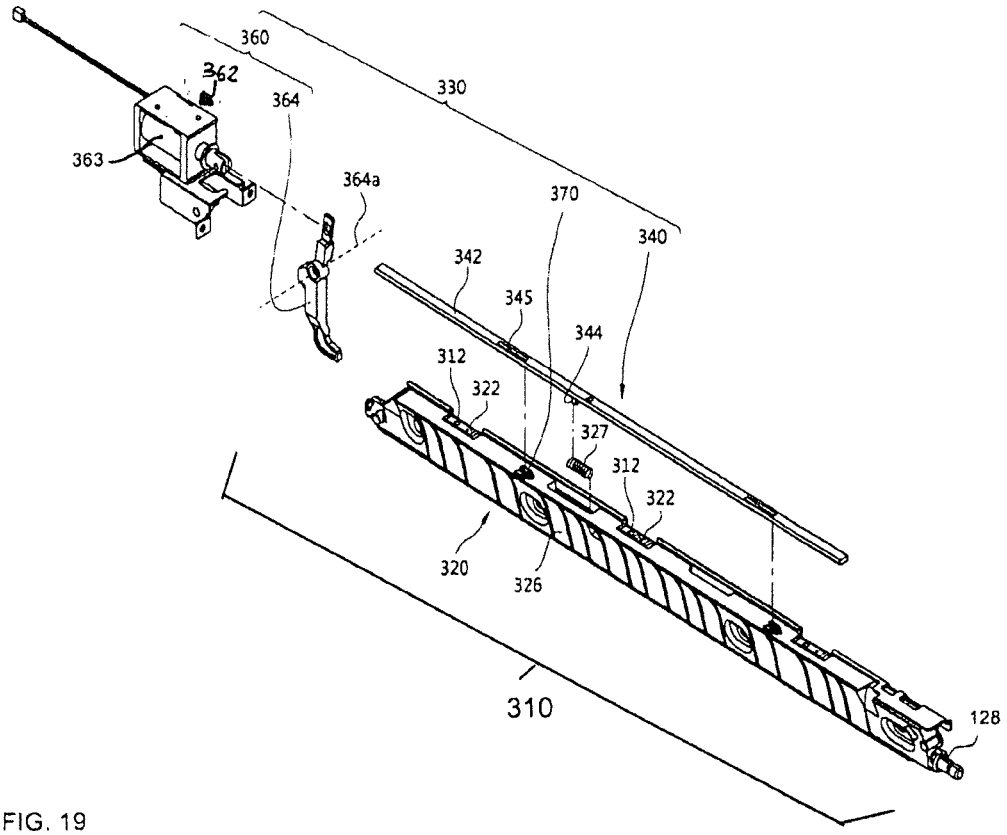
FIG. 18 is an exploded perspective view of the sensing assembly according to the third embodiment of the present invention.

FIG. 17 is a perspective view of a sensing assembly according to a third embodiment of the present invention, and FIG. 18 is an exploded perspective view of the sensing assembly according to the third embodiment of the present invention.

A sensing assembly 300 includes a sensing unit 310 and a shutter device 330 provided to selectively open and close the sensing unit 310.

The sensing unit 310 is provided to inspect a developer disposed on the transfer member 51.

The sensing unit 310 includes a plurality of sensors 312 which inspect the developer disposed on the transfer member 51, a sensor housing 320 in which the plurality of sensors 312 are accommodated and installed.

The shutter device 330 includes a shutter 340, a shutter driving device 360, and a latch unit 370.

The shutter 340 includes a shutter body 342 formed in a long shape in the second direction W2 and a guide bar 344.

The guide bar 344 is provided on the shutter body 342 to guide movement of the shutter 340. The guide bar 344 extends from the shutter body 342 and is formed on the shutter body 342. Sides 345 of the guide bar 344 are provided to be separated a predetermined interval from the shutter body 342 to be elastically operated. The guide bar 344 may be formed in a longitudinal direction of the shutter 340. The guide bar 344 includes a guide protrusion 346 which is provided on one end thereof and moves along a guide groove 372 which will be described below.

At least one guide protrusion 346 may be provided. When the guide protrusion 346 is provided in a plural number, the plurality of guide protrusions 346 may be separated and disposed in a longitudinal direction of the shutter body 342.

The shutter driving device 360 may include a driving part 362 and a lever 364 which is pressed by the driving part 362 and presses the other end of the shutter 340. The driving part 362 includes a solenoid 363 capable of moving back and forth. The lever 364 is provided to be capable of rotating about the lever rotational part 364*a*. The shutter driving device 360 is provided on one end of the shutter 340, and provided to press the shutter 340 in a 2A direction W2*a* which is perpendicular to the first direction W1 and is a direction from one end of the shutter 340 to the other end of the shutter 340. The configuration of the shutter driving device 360 is not limited, and the shutter 340 may be provided to be pressed in the 2A direction W2*a*.

The sensing unit 310 may include an elastic restoring member 327. The elastic restoring member 327 is provided on the sensor housing 320, and provided to elastically support the shutter 340 in a 2B direction Web opposite the 2A direction W2*a*.

Figure 19:
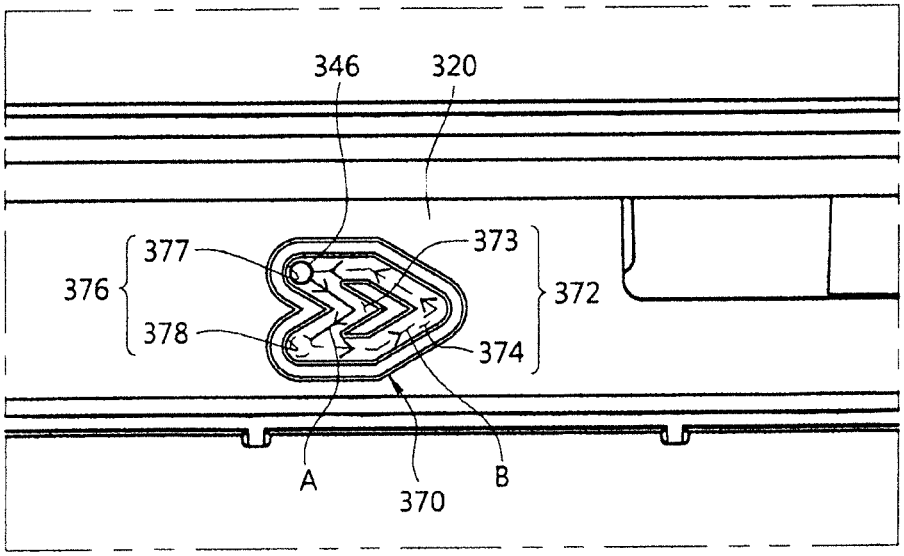
FIG. 19 is a view illustrating an operation of a latch unit according to the third embodiment of the present invention.

FIG. 19 is a view illustrating an operation of a latch unit according to the third embodiment of the present invention.

A latch unit 370 guides movement of the shutter 340 between the first position P1 and the second position P2.

The latch unit 370 may include a guide groove 372 and a protrusion mounting part 376.

The guide groove 372 is provided on an upper side of the sensor housing 320 in a groove shape, and provided to guide movement of the guide protrusion 346.

The protrusion mounting part 376 is provided on the guide groove 372 so that the guide protrusion 346 is mounted. The protrusion mounting part 376 includes a first protrusion mounting part 377 and a second protrusion mounting part 378 disposed to be separated from the first protrusion mounting part 377 in the first direction W1.

The guide protrusion 346 is mounted on the first protrusion mounting part 377 when the shutter 340 is positioned at the first position P1 at which the window 322 is closed, and the guide protrusion 346 is mounted on the second protrusion mounting part 378 when the shutter 340 is positioned at the second position P2 at which the window 322 is opened.

In the embodiment of the present invention, the first protrusion mounting part 377 and the second protrusion mounting part 378 are provided to be separated only in the first direction W1, but the embodiment is not limited thereto, and the embodiment may be satisfied when the first protrusion mounting part 377 at the first position P1 at which the shutter 340 closes the window 322, and the second protrusion mounting part 378 at the second position P2 at which the shutter 340 opens the window 322 may be positioned to be separated from each other according to displacement in the first direction W1.

The guide groove 372 includes a first guide groove 373 and a second guide groove 374.

The first guide groove 373 is provided to guide movement of the guide protrusion 346 from the first protrusion mounting part 377 to the second protrusion mounting part 378, and the second guide groove 374 is provided to guide the movement of the guide protrusion 346 from the second protrusion mounting part 378 to the first protrusion mounting part 377.

The first guide groove 373 and the second guide groove 374 do not cross each other so that movement of the guide protrusion 346 may be performed along a closed curve.

The shutter driving device 360 presses the shutter 340 in the 2A direction W2*a* so that the guide protrusion 346 from any one of the pair of protrusion mounting parts 376 is detached, and the elastic restoring member 327 presses the shutter 340 in the 2B direction W2*b* so that the guide protrusion 346 detached from any one of the pair of protrusion mounting parts 376 by the shutter driving device 360 is moved to the other guide protrusion 346.

According to the above configuration, since the guide protrusion 346 is mounted on the first protrusion mounting part 377 or second protrusion mounting part 378, the shutter 340 is positioned at the first position P1 or second position P2.

Hereinafter, an operation of the sensing assembly 300 according to the above configuration will be described.

Figure 20A:
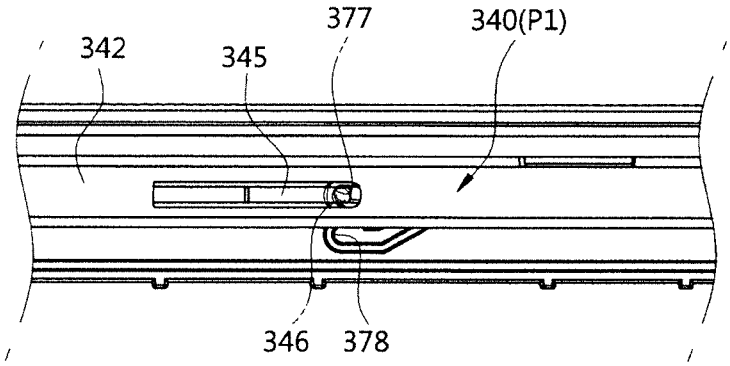
FIGS. 20A and 20B are views illustrating an operation of the sensing assembly according to the third embodiment of the present invention.
Figure 20B:
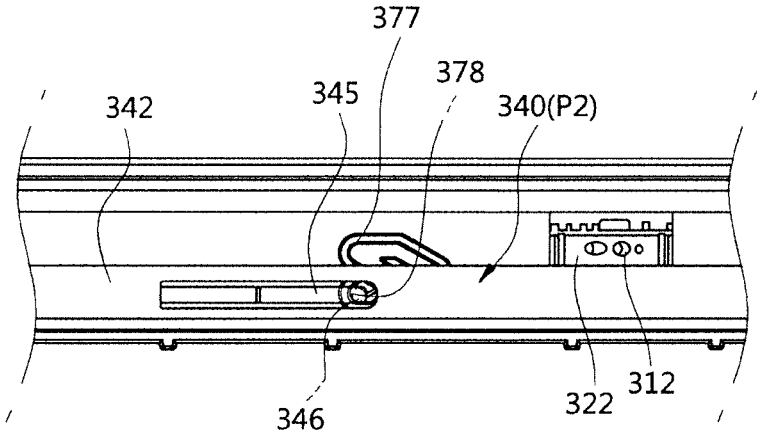
Figure 21A:
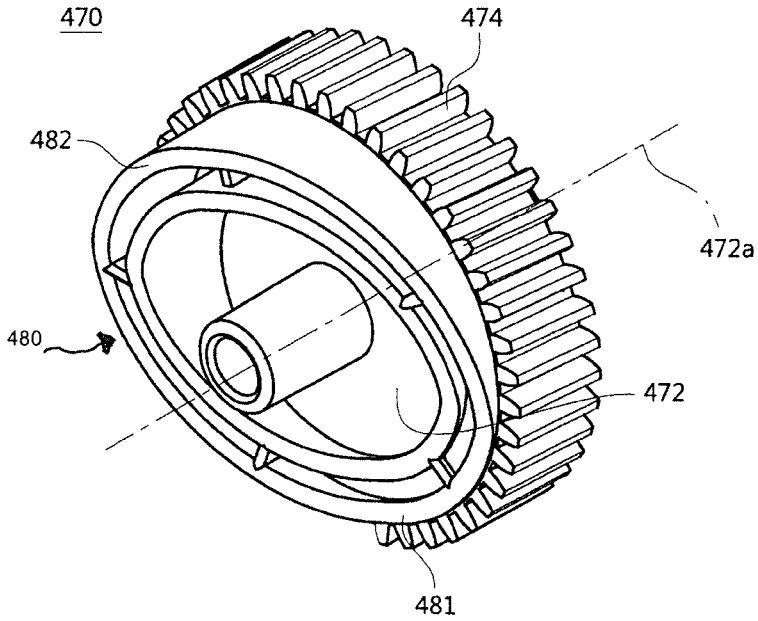
FIGS. 21A and 21B are a perspective view of a cam gear according to the fourth embodiment of the present invention.
Figure 21B:
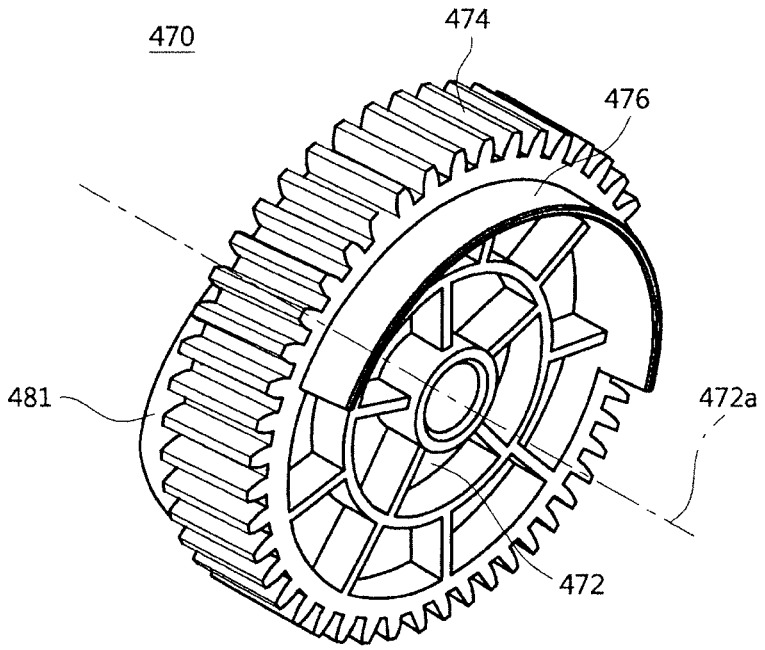

FIGS. 20A and 20B are views illustrating an operation of the sensing assembly according to the third embodiment of the present invention.

At the first position P1 at which the shutter 340 closes the window 322, the guide protrusion 346 of the shutter 340 is provided to be positioned on the first protrusion mounting part 377.

In the above state, when the shutter driving device 360 is operated and the shutter 340 is pressed in the 2A direction W2*a*, the guide protrusion 346 is detached from the first protrusion mounting part 377 and is moved along the first guide groove 373. The elastic restoring member 327 is provided so that the shutter body 342 is returned in the 2B direction W2*b*, and the guide protrusion 346 detached from the first protrusion mounting part 377 is mounted on the second protrusion mounting part 378 disposed on an end portion of the first guide groove 373. That is, the guide protrusion 346 is moved from the first protrusion mounting part 377 to the second protrusion mounting part 378 along a line A. By this process, the shutter 340 is positioned at the second position P2 at which the window 322 is opened.

In the above state, when the shutter driving device 360 is operated and the shutter 340 is pressed in the 2A direction W2*a* again, the guide protrusion 346 is detached from the second protrusion mounting part 378 and is moved along the second guide groove 374. The elastic restoring member 327 is provided so that the shutter body 342 is returned in the 2B direction Web, and the guide protrusion 346 detached from the second protrusion mounting part 378 is mounted on the first protrusion mounting part 377 disposed on an end portion of the second guide groove 374. That is, the guide protrusion 346 is moved from the second protrusion mounting part 378 to the first protrusion mounting part 377 along a line B. By this process, the shutter 340 is positioned at the first position P1 at which the window 322 is closed.

That is, the guide protrusion 346 is moved between the first protrusion mounting part 377 and the second protrusion mounting part 378 by the shutter driving device 360 and the elastic restoring member 327, and thus the shutter 340 is provided to be moved between the first position P1 and the second position P2.

Further, the first protrusion mounting part 377 and the second protrusion mounting part 378 are provided to be separated from each other in the first direction W1, and thus the latch unit 370 is provided to move the shutter 340 only according to displacement in the first direction W1.

Hereinafter, an image forming apparatus according to a fourth embodiment will be described.

In the below description, the description of configurations duplicated with those of the above described embodiments will be omitted.

In the embodiment of the present invention, a shape of the cam gear 170 is different from that of the first embodiment.

A cam gear 470 includes a gear body 472, a worm wheel 474 provided so that the gear body 472 interlocked with a worm 264 of a driving part 262 is rotated, a protrusion mounting part 476, and a cam rail 480 provided on one side of the gear body 472 to operate the shutter 340.

The cam rail 480 may be provided in a plural number to stably support the shutter 340. The plurality of cam rails 480 are formed to be separated a predetermined interval from each other and parallel to each other. In the embodiment of the present invention, a pair of cam rails 480 are provided.

Since the plurality of cam rails 480 are provided, a rail contact surface 148 of the shutter 340 may be stably supported.

The cam rail 480 includes the first cam rail 481 and the second cam rail 482. In the embodiment of the present invention, the first cam rail 481 and the second cam rail 482 are formed to have the same radius from the rotation axis 472*a*, but the radii may be different from each other.

The first cam rail 481 is formed to have a height h1 from the gear body 472 in the cam rail 480, and the second cam rail 482 is formed to have a height h2 from the gear body 472 in the cam rail 480. h1 is formed to be smaller than h2. Unlike the first embodiment, the first cam rail 481 and the second cam rail 482 may not be formed in a predetermined distance, and may be formed as one point. That is, the cam rail 480 may be provided to increase or decrease a height with a predetermined ratio according to rotation of the cam gear 470 at an arbitrary point of the cam rail 480 based on positions of the first cam rail 481 and the second cam rail 482 as minimum and maximum heights, respectively.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. An image forming apparatus comprising:

a transfer member to rotate and to which a developer is transferrable to transfer the developer onto a printing medium; and a sensor assembly including, a sensor to sense the developer transferred onto the transfer member through a window disposed between the sensor and the transfer member; and a shutter device having a shutter movable in an oblique direction to open and close the window.

2. The apparatus according to claim 1, wherein:

the shutter includes a first position at which the window is closed and a second position at which the window is opened; and the shutter is movable in the oblique direction between the first position and the second position according to a displacement in a first direction and a displacement in a second direction perpendicular to the first direction.

3. The apparatus according to claim 1, further comprising:

a shutter driving device coupled to the shutter device, the shutter driving device having a cam gear, which is rotatably provided to convert a rotation of the cam gear into movement of the shutter to drive the shutter to open and close the window.

4. The apparatus according to claim 3, wherein the cam gear includes:

a gear body; and a cam rail provided on one side of the gear body to guide the movement of the shutter.

5. The apparatus according to claim 4, wherein the shutter is guided by the movement of the cam rail and reciprocates in an oblique direction having a displacement in a first direction and a displacement in a second direction perpendicular to the first direction according to rotation of the cam gear.

6. The apparatus according to claim 4, wherein the shutter includes:

a shutter body to open and close the window; and a guide pole provided on the shutter body to be movable along the cam rail.

7. The apparatus according to claim 6, wherein:

the cam rail is formed such that a radial distance (r) from a center of the rotation of the cam gear to the cam rail varies according to the rotation of the cam gear; and the guide pole is guided by the cam rail by the rotation of the cam gear and moves based on a displacement in a first direction.

8. The apparatus according to claim 7, wherein the shutter includes:

a first position at which the window is closed; and a second position at which the window is opened, wherein the shutter is positioned at the first position when the radial distance of the cam rail to which the guide pole is guided is r1, the shutter is positioned at the second position when the radial distance of the cam rail to which the guide pole is guided is r2, and the r1 is formed to be greater than the r2, wherein the shutter has the displacement in the first direction by the rotation of the cam gear and reciprocates a distance between the r1 and the r2.

9. The apparatus according to claim 6, wherein:

the shutter includes a first position at which the window is closed and a second position at which the window is opened; and the shutter body is formed to seal a surface located at a same level as the window in a width direction of the transfer member when the shutter is disposed at the first position.

10. The apparatus according to claim 3, wherein the shutter driving device further includes:

a driving unit having a driving motor to generate a rotating force, and a worm to rotate by the driving motor; and the cam gear further includes a worm wheel, which is meshed with the worm to rotatably couple the shutter to the shutter driving device.

11. The apparatus according to claim 3, wherein:

the sensor assembly further includes a sensor housing which accommodates the sensor;

the shutter includes a first position at which the window is closed and a second position at which the window is opened; and the shutter is moved from the first position to the second position by the shutter driving device, and moved from the second position to the first position by an elastic restoring force of an elastic member provided between the sensor housing and the shutter.

12. The apparatus according to claim 3, wherein the cam gear includes a detection part, and the shutter driving device further includes a rotational position detection sensor to sense the detection part to detect a rotational position of the cam gear corresponding to a first position in which the shutter is to open the window and to a second position in which the shutter is to close the window.

13. The apparatus according to claim 1, wherein
the transfer member is to rotate in a first direction,
the shutter device has a latch unit which guides movement of the shutter,
the sensor assembly includes a sensor housing which accommodates the sensor;
the shutter includes a guide protrusion formed to protrude toward the sensor housing; and
the latch unit includes:
a guide groove provided on the sensor housing and to guide movement of the guide protrusion; and
a pair of protrusion mounting parts having a first protrusion mounting part on which the guide protrusion is mounted, and a second protrusion mounting part disposed to be further spaced in the first direction than the first protrusion mounting part, and provided on the guide groove,
wherein, when the shutter is positioned at the first position, the guide protrusion is mounted on the first protrusion mounting part, and
when the shutter is positioned at the second position, the guide protrusion is mounted on the second protrusion mounting part.

14. The apparatus according to claim 13, wherein the guide groove includes:
a first guide groove to guide movement of the guide protrusion from the first protrusion mounting part to the second protrusion mounting part; and
a second guide groove to guide movement of the guide protrusion from the second protrusion mounting part to the first protrusion mounting part and separated from the first guide groove.

15. The apparatus according to claim 13, further comprising a shutter driving device coupled to one end of the shutter, to press the shutter in a press direction, which is perpendicular to the first direction and in a direction from one end of the shutter to other end of the shutter, to detach the guide protrusion from any one of the first protrusion mounting part and the second protrusion mounting part,
wherein the sensor assembly includes an elastic restoring member provided on the sensor housing to elastically support the shutter in a restoring direction opposite the press direction to move the guide protrusion, which is detachable from any one of the first protrusion mounting part and the second protrusion mounting part by the shutter driving device.

16. The apparatus according to claim 15, wherein the latch unit further includes a guide bar provided on the shutter to form the guide protrusion on an end portion thereof and formed in a longitudinal direction of the shutter.

17. The apparatus according to claim 16, wherein the shutter includes:
a first position at which the window is closed; and
a second position at which the window is opened,
wherein
the cam rail is formed such that a height (h) in an axial direction of the cam gear varies according to the rotation of the cam gear,
the guide pole is provided to move according to a displacement in the first direction and a displacement in a second direction perpendicular to the first direction along the cam rail by the rotation of the cam gear,
the shutter is positioned at the first position when a radial distance of the cam rail to which the guide pole is guided is r1 and the height in the axial direction is h1,
the shutter is positioned at the second position when a radial distance of the cam rail to which the guide pole is guided is r2 and a height in the axial direction is h2, and
the r1 is formed to be greater than the r2, and the h2 is formed to be greater than the h1.

18. The apparatus according to claim 17, wherein the shutter is movable in an oblique direction according to the displacement in the first direction as much as a difference between the r1 and r2 and the displacement in the second direction as much as a difference between the h1 and h2.

19. The apparatus according to claim 1, wherein:
the transfer member is to rotate in a first direction,
the sensor assembly further includes a sensor housing which accommodates the sensor; and
the sensor housing includes,
a plurality of guide rails which are,
separated from each other in a second direction perpendicular to the first direction and longitudinal to the sensor housing, and
formed to move the shutter in the oblique direction having a displacement in the first direction and a displacement in the second direction.

20. A sensor assembly of an image forming apparatus, the sensor assembly comprising:
a sensor to sense a developer through a window disposed between the sensor and a transfer member to which the developer is transferrable to transfer the developer onto a print medium; and
a shutter movable in an oblique direction to open the window to allow the sensor to sense the developer and to close the window.

* * * * *